US011221572B2

(12) United States Patent
Ishizumi et al.

(10) Patent No.: US 11,221,572 B2
(45) Date of Patent: Jan. 11, 2022

(54) IMAGE FORMING APPARATUS

(71) Applicant: CANON KABUSHIKI KAISHA, Tokyo (JP)

(72) Inventors: Keisuke Ishizumi, Hiratsuka (JP); Shohei Ishio, Tokyo (JP); Shinji Katagiri, Yokohama (JP); Takayuki Tanaka, Tokyo (JP); Tsuguhiro Yoshida, Yokohama (JP); Shuichi Tetsuno, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/903,894

(22) Filed: Jun. 17, 2020

(65) Prior Publication Data

US 2020/0319578 A1 Oct. 8, 2020

Related U.S. Application Data

(63) Continuation of application No. 16/664,718, filed on Oct. 25, 2019, now Pat. No. 10,725,402.

(30) Foreign Application Priority Data

Oct. 29, 2018 (JP) ..... JP2018-203271
Nov. 30, 2018 (JP) ..... JP2018-225248

(51) Int. Cl.
*G03G 15/20* (2006.01)
*G03G 15/16* (2006.01)

(52) U.S. Cl.
CPC ..... *G03G 15/1605* (2013.01); *G03G 15/1685* (2013.01)

(58) Field of Classification Search
CPC ..... G03G 15/1605; G03G 15/1685; G03G 15/162
USPC ..... 399/302, 308
See application file for complete search history.

(56) References Cited

U.S. PATENT DOCUMENTS

2010/0316420 A1* 12/2010 Mori ..... G03G 15/162 399/302
2019/0369528 A1* 12/2019 Tanaka ..... G03G 15/162

* cited by examiner

*Primary Examiner* — Hoang X Ngo
(74) *Attorney, Agent, or Firm* — Canon U.S.A., Inc. I.P. Division

(57) ABSTRACT

An intermediate transfer belt has a first region and a second region in an outer circumferential surface thereof that is in contact with a blade. The first region has a first dynamic friction coefficient in a belt conveyance direction, and the second region has a second dynamic friction coefficient. The distance of the second region in the belt conveyance direction is less than the distance of the first region and is greater than the distance of a contact portion in which the blade is in contact with the intermediate transfer belt.

14 Claims, 12 Drawing Sheets

IMAGE FORMING APPARATUS

CROSS-REFERENCE TO RELATED APPLICATIONS

The present application is a continuation of U.S. patent application Ser. No. 16/664,718, filed on Oct. 25, 2019, which claims priority from Japanese Patent Application No. 2018-203271 filed Oct. 29, 2018 and Japanese Patent Application No. 2018-225248 filed Nov. 30, 2018, which are hereby incorporated by reference herein in their entireties.

BACKGROUND OF THE INVENTION

Field of the Invention

The present invention relates to an image forming apparatus using an electrophotographic process, such as a laser printer, a copying machine, and a facsimile.

Description of the Related Art

Some of existing electrophotographic color image forming apparatuses have a configuration using an intermediate transfer method in which a toner image is sequentially transferred from an image forming unit of each color to an intermediate transfer member and, thereafter, the toner images are transferred from the intermediate transfer member to a transfer medium in one go.

In image forming apparatuses having such a configuration, the image forming unit of each color includes a drum-shaped photoconductive member (hereinafter referred to as a "photoconductive drum) serving as an image bearing member. As the intermediate transfer member, an intermediate transfer belt in the form of an endless belt is widely used. A toner image formed on the photoconductive drum of each of the image forming units is primarily transferred onto the intermediate transfer belt by applying a voltage from a primary transfer power source to a primary transfer member, which is provided so as to face the photoconductive drum via the intermediate transfer belt. The color toner images primarily transferred from the image forming units of the colors to the intermediate transfer belt are secondarily transferred from the intermediate transfer belt to a transfer medium, such as a paper sheet or an OHP sheet, in one go by applying a voltage from the secondary transfer power source to the secondary transfer member in a secondary transfer portion. Secondary transfer is performed on the transfer medium. Subsequently, the toner images of the respective colors transferred to the transfer medium are fixed onto the transfer medium by a fixing unit.

In the image forming apparatus of an intermediate transfer type, toner (residual transfer toner) remains on the intermediate transfer belt after a toner image is secondarily transferred from the intermediate transfer belt to a transfer medium. Accordingly, the residual transfer toner needs to be removed from the intermediate transfer belt before a toner image corresponding to the next image is primarily transferred to the intermediate transfer belt.

As a cleaning method for removing the transfer residual toner, a blade cleaning method is widely used. According to the blade cleaning method, the transfer residual toner is scraped off and collected into a cleaning container by a cleaning blade that is disposed downstream of the secondary transfer portion in the movement direction of the intermediate transfer belt and that is in contact with the intermediate transfer belt. In general, an elastic body, such as urethane rubber, is used as a cleaning blade. The cleaning blade is normally disposed such that an edge portion of the cleaning blade is in pressure contact with the intermediate transfer belt in a direction opposite to the movement direction of the intermediate transfer belt (a counter direction).

Japanese Patent Laid-Open No. 2015-125187 describes a configuration in which the intermediate transfer belt has, on a surface thereof, grooves extending in the movement direction of the intermediate transfer belt in order to prevent wear of the cleaning blade. In the configuration, by reducing the contact area between the cleaning blade and the intermediate transfer belt, the friction coefficient between the cleaning blade and the intermediate transfer belt is reduced and, thus, wear of the cleaning blade is prevented.

The durability of the cleaning blade can be increased by using the configuration described in Japanese Patent Laid-Open No. 2015-125187. However, if the image forming apparatus is used for a longer period of time, it is required that the durability of the cleaning blade be increased more to prevent the occurrence of faulty cleaning.

SUMMARY OF THE INVENTION

Accordingly, the present invention provides a configuration that collects residual toner on an intermediate transfer member by a contact member in contact with the intermediate transfer member to increase the durability of the contact member and prevent the occurrence of faulty cleaning.

According to an aspect of the present invention, an image forming apparatus includes an image bearing member configured to bear a toner image, a movable intermediate transfer member in contact with the image bearing member, where the toner image born by the image bearing member is primarily transferred to the intermediate transfer member, and a contact member disposed downstream of a secondary transfer portion in the movement direction of the intermediate transfer member. The toner image primarily transferred to the intermediate transfer member is secondarily transferred from the intermediate transfer member to a transfer medium in the secondary transfer portion, and the contact member forms a contact portion in contact with the intermediate transfer member and collects residual toner remaining on the intermediate transfer member after the toner passes through the secondary transfer portion. The intermediate transfer member has a first region and a second region that differs from the first region arranged in the movement direction. The first region has a plurality of grooves arranged in the width direction, and the grooves extend in the movement direction. The second region has a dynamic friction coefficient in the movement direction, and dynamic friction coefficient is less than a dynamic friction coefficient of the first region in the movement direction. A length of the second region in the movement direction is less than a length of the first region in the movement direction and is greater than a length of the contact portion in the movement direction.

Further features of the present invention will become apparent from the following description of exemplary embodiments with reference to the attached drawings.

DESCRIPTION OF THE EMBODIMENTS

Exemplary embodiments of the present invention are described below with reference to the accompanying drawings. Note that constituent elements of the exemplary embodiments are very flexible in size, material, shape and relative positional relationship and should be changed in accordance with the configuration and various conditions of the apparatus of the invention. Thus, the following embodiments are not intended to limit the scope of the present invention in any way.

First Exemplary Embodiment

Image Forming Apparatus

Figure 1:
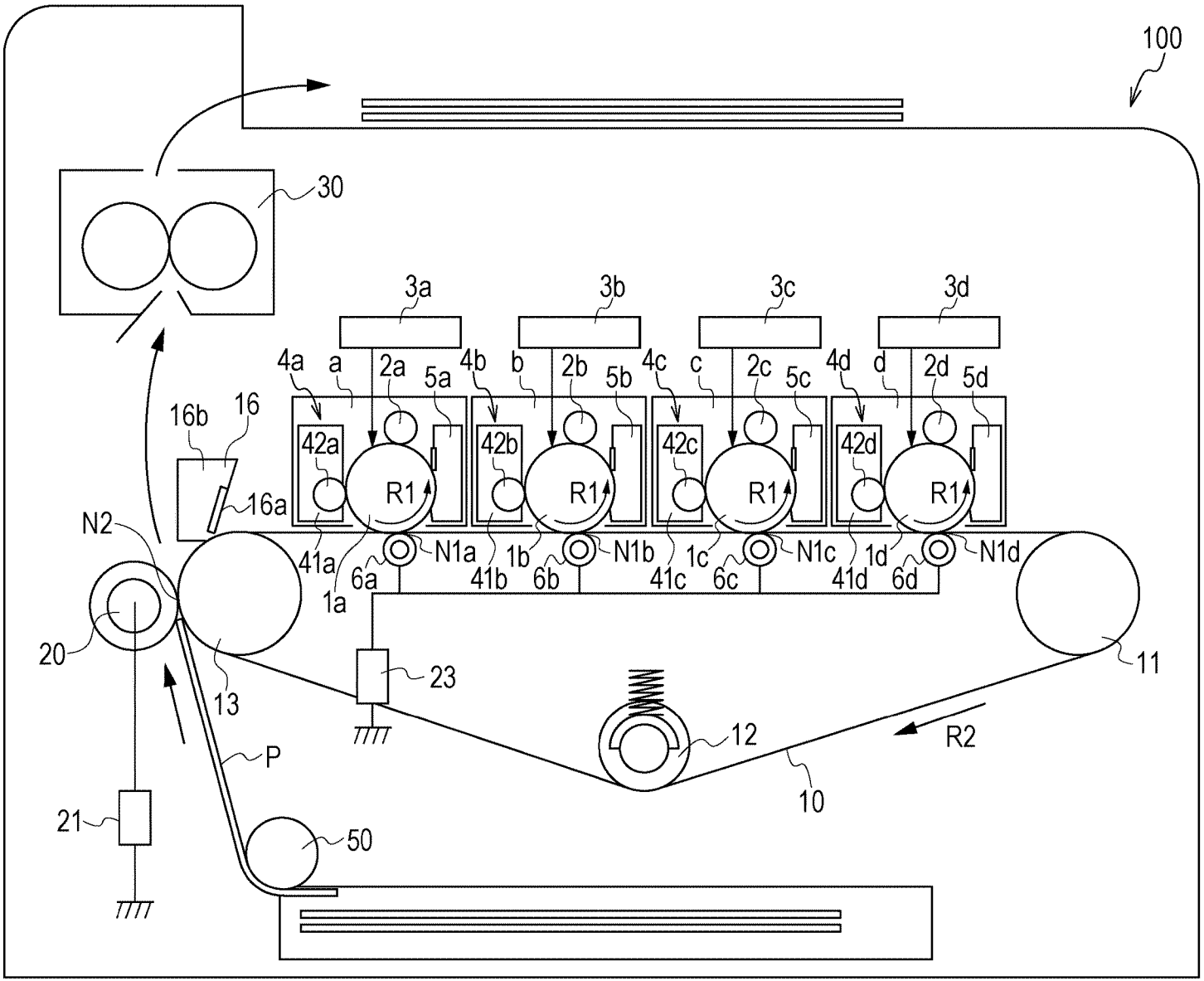
FIG. 1 is a schematic sectional view of an image forming apparatus according to a first exemplary embodiment.

FIG. 1 is a schematic cross-sectional view of the configuration of an image forming apparatus 100 according to the present exemplary embodiment. The image forming apparatus 100 according to the present exemplary embodiment is what is called tandem type image forming apparatus provided with a plurality of image forming units a to d. The first image forming unit a forms an image by using yellow (Y) toner, the second image forming unit b forms an image by using magenta (M) toner, the third image forming unit c forms an image by using cyan (C) toner, and the fourth image forming unit d forms an image by using black (Bk) toner. These four image forming units are arranged in a line at regular intervals, and the four image forming units have substantially the same configuration except for the color of the toner to be stored. For this reason, the image forming apparatus 100 according to the present exemplary embodiment is described below with reference to the first image forming unit a.

The first image forming unit a includes a photoconductive drum 1*a* which is a drum-shaped photoconductive member, a charging roller 2*a* which is a charging member, a developing unit 4*a*, and a drum cleaning unit 5*a*.

The photoconductive drum 1*a* is an image bearing member that bears a toner image and is driven to rotate in a direction indicated by an arrow R1 in FIG. 1 at a predetermined process speed (200 mm/sec according to the present exemplary embodiment). The developing unit 4*a* includes a developer container 41*a* for storing yellow toner and a development roller 42*a* which is a developing member. The development roller 42*a* bears the yellow toner stored in the developer container 41*a* and develops a yellow toner image on the photoconductive drum 1*a*. The drum cleaning unit 5*a* is a unit for collecting the toner adhering to the photoconductive drum 1*a*. The drum cleaning unit 5*a* includes a cleaning blade that is in contact with the photoconductive drum 1*a* and a waste toner box that stores, for example, toner removed from the photoconductive drum 1*a* by the cleaning blade.

When a control unit (not illustrated) receives an image signal, an image forming operation is started, and the photoconductive drum 1*a* is driven to rotate. During rotation, the photoconductive drum 1*a* is uniformly charged to a predetermined potential (a charging potential) with a predetermined polarity (a negative polarity according to the present exemplary embodiment) by the charging roller 2*a* and, thereafter, is exposed to light according to the image signal by the exposure unit 3*a*. In this way, an electrostatic latent image corresponding to the yellow component image of a target color image is formed. Subsequently, the electrostatic latent image is developed by the developing unit 4*a* at a development position and is visualized as a yellow toner image (hereinafter simply referred to as a "toner image"). At this time, the normal charging polarity of the toner stored in the developing unit 4*a* is negative. According to the present exemplary embodiment, an electrostatic latent image is developed using discharged area development, with the toner charged to the same polarity as the charging polarity of the photoconductive drum by the charging member. However, the present invention is applicable to the image forming apparatus that develops an electrostatic latent image by using charged area development, with toner charged to a polarity opposite to the charging polarity of the photoconductive drum.

An intermediate transfer belt 10 (intermediate transfer member), which is an endless movable intermediate transfer member, is disposed at a position so as to be in contact with the photoconductive drums 1*a* to 1*d* of the image forming units a to d, respectively. The intermediate transfer belt 10 is stretched around three axes of a support roller 11, a tension roller 12, and a facing roller 13, which serve as stretching members. The intermediate transfer belt 10 is maintained in tension by a tension roller 12 with a total pressure of 60N. The intermediate transfer belt 10 moves in the direction indicated by arrow R2 due to the rotation of the facing roller 13 that rotates in accordance with a received driving force.

The intermediate transfer belt 10 according to the present exemplary embodiment has a plurality of layers (described in more detail below).

When the toner image passes through a primary transfer portion N1*a* at which the photoconductive drum 1*a* is in contact with the intermediate transfer belt 10, a voltage with a positive polarity is applied from a primary transfer power source 23 to the primary transfer roller 6*a* and, thus, the toner image formed on the photoconductive drum 1*a* is primarily transferred onto the intermediate transfer belt 10. Subsequently, the residual toner that is not primarily transferred to the intermediate transfer belt 10 and remains on the photoconductive drum 1*a* is collected by the drum cleaning unit 5*a*. In this manner, the residual toner is removed from the surface of the photoconductive drum 1*a*.

Note that the primary transfer roller 6*a* is a primary transfer member (a touching member) that is provided at a position corresponding to the photoconductive drum 1*a* via the intermediate transfer belt 10 and that is in contact with the inner peripheral surface of the intermediate transfer belt 10. The primary transfer power source 23 is a power source capable of applying a voltage with a positive or negative polarity to the primary transfer rollers 6*a* to 6*d*. While the present exemplary embodiment is described with reference to a configuration in which a voltage is applied from a shared primary transfer power source 23 to a plurality of primary transfer members, the present invention is not limited thereto. The present invention can be applied to a configuration in which a plurality of primary transfer power sources are provided corresponding to the primary transfer members.

Thereafter, in the same manner, a second magenta toner image, a third cyan toner image, and a fourth black toner image are formed and sequentially transferred onto the intermediate transfer belt 10 on top of another. As a result, the four color toner images corresponding to the target color image is formed on the intermediate transfer belt 10. Subsequently, when the four color toner images born by the intermediate transfer belt 10 pass through a secondary transfer portion formed by contact of the secondary transfer roller 20 with the intermediate transfer belt 10, the four color toner images are secondarily transferred onto a surface of a transfer medium P, such as a paper sheet or an OHP sheet, fed by a sheet feeding unit 50 in one go.

The secondary transfer roller 20 has an outer diameter of 18 mm and is formed by covering a nickel-plated steel rod having an outer diameter of 8 mm with a foamed sponge body mainly composed of NBR and epichlorohydrin rubber and having an adjusted volume resistivity of $10^8$ Ω·cm and an adjusted thickness of 5 mm. Note that the rubber hardness of the foamed sponge body was measured by using Asker hardness meter type C, and the hardness was 30° when loaded with 500 g. The secondary transfer roller 20 is in contact with the outer circumferential surface of the intermediate transfer belt 10, and a pressure of 50N is applied to the facing roller 13 disposed at a position facing the secondary transfer roller 20 via the intermediate transfer belt 10. Thus, a secondary transfer portion N2 is formed.

The secondary transfer roller 20 is driven to rotate by the revolution of the intermediate transfer belt 10. When a voltage is applied from a secondary transfer power source 21 to the secondary transfer roller 20, a current flows from the secondary transfer roller 20 toward the facing roller 13. As a result, the toner image born by the intermediate transfer belt 10 is secondarily transferred to the transfer medium P in the secondary transfer portion. Note that when the toner image on the intermediate transfer belt 10 is secondarily transferred to the transfer medium P, the voltage applied from the secondary transfer power source 21 to the secondary transfer roller 20 is controlled such that the current flowing from the secondary transfer roller 20 to the facing roller 13 via the intermediate transfer belt 10 is constant. In addition, the magnitude of the current for performing the secondary transfer is determined in advance in accordance with the surrounding environment in which the image forming apparatus 100 is installed and the type of the transfer medium P. The secondary transfer power source 21 is connected to the secondary transfer roller 20 and applies a transfer voltage to the secondary transfer roller 20. The secondary transfer power source 21 can output a voltage in the range of 100 (V) to 4000 (V).

Subsequently, the transfer medium P having the four color toner images transferred thereon through secondary transfer is heated and pressurized in a fixing unit 30. Thus, the four color toner particles are melted and mixed. The melted toner is fixed to the transfer medium P. The toner remaining on the intermediate transfer belt 10 after the secondary transfer is cleaned or removed by a belt cleaning unit 16 (a collection unit) provided downstream of the secondary transfer portion N2 in the movement direction of the intermediate transfer belt 10. The belt cleaning unit 16 includes a cleaning blade 16*a* serving as a contact member that is in contact with the outer circumferential surface of the intermediate transfer belt 10 at a position facing the facing roller 13, a waste toner container 16*b* that stores the toner collected by the cleaning blade 16*a*. Hereinafter, the cleaning blade 16*a* is simply referred to as a "blade 16*a*".

In the image forming apparatus 100 according to the present exemplary embodiment, a full-color print image is formed through the above-described operation.

Belt Cleaning Unit

Figure 2A:
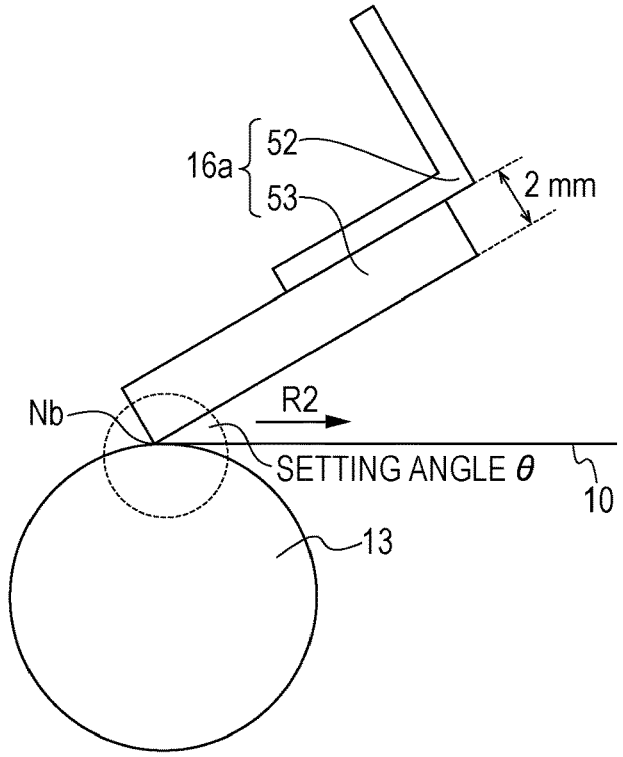
FIGS. 2A to 2C are schematic illustrations of a belt cleaning unit according to the first exemplary embodiment.
Figure 2B:
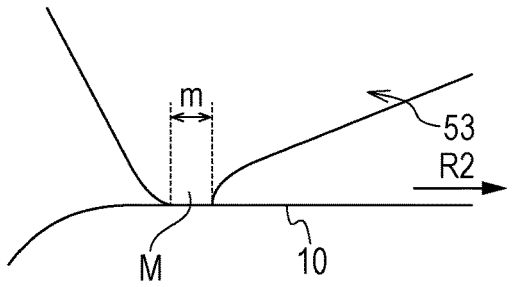

FIG. 2A is a schematic illustration of the blade 16*a* in contact with the intermediate transfer belt 10, and FIG. 2B is an enlarged schematic illustration of a contact portion between the blade 16*a* and the intermediate transfer belt 10. According to the present exemplary embodiment, the blade 16*a* is a plate-like member having a long side extending in the width direction of the intermediate transfer belt 10 (hereinafter referred to as a "belt width direction") that crosses the movement direction of the intermediate transfer belt 10 (hereinafter referred to as a "belt conveyance direction").

According to the present exemplary embodiment, the blade 16*a* has an elastic portion 53 that is in contact with the intermediate transfer belt 10 and that scrapes off the toner and a sheet metal portion 52 (a support portion) that supports the elastic portion 53. The elastic portion 53 is a blade member made of polyurethane. One end in the short direction of the elastic portion 53 is fixed to the sheet metal portion 52, and the other end is a free end that is in free contact with the intermediate transfer belt 10. More specifically, the blade 16*a* has a blade shape and includes the elastic portion 53 that is in contact with the intermediate transfer belt 10. The width of the elastic portion 53 is 230 mm. The elastic portion 53 is bonded to the sheet metal portion 52 to form the blade 16*a*. The length of the elastic portion 53 of the blade 16*a* (in the belt width direction) is 230 mm, and the thickness of the elastic portion 53 is 2 mm. A free length, which is a length from a bonding point with the sheet metal portion 52, is 13 mm. The hardness of the blade 16*a* is 77 degrees defined by JIS K 6253 standard.

The facing roller 13 is disposed adjacent to the inner periphery of the intermediate transfer belt 10 so as to face the blade 16*a*. The blade 16*a* is in contact with the surface of the intermediate transfer belt 10 at a position facing the facing roller 13 so as to be directed in the counter direction (a direction opposite to the belt conveyance direction). That is, the blade 16*a* is in contact with the surface of the intermediate transfer belt 10 such that the free end is directed upstream in the belt conveyance direction. Thus, as illustrated in FIG. 2A, a blade nip portion Nb (a contact portion) is formed between the blade 16*a* and the intermediate transfer belt 10. The blade 16*a* scrapes off toner on the surface of the moving intermediate transfer belt 10 at the blade nip portion Nb and collects the toner into the waste toner container 16*b*. According to the present exemplary embodiment, the width of the blade nip portion Nb where the blade 16*a* and the intermediate transfer belt 10 are in contact with each other in the belt conveyance direction is 75 μm.

Figure 2C:
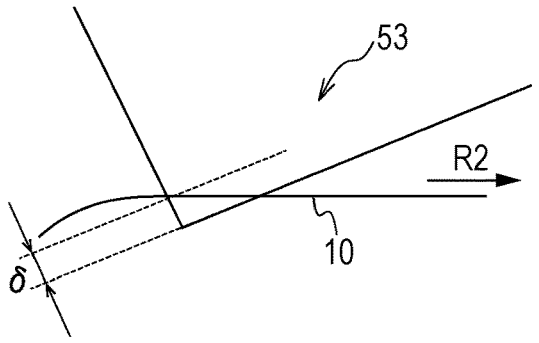

According to the configuration of the present exemplary embodiment, as illustrated in FIG. 2B, since the blade 16*a* is disposed so as to be directed in the counter direction, the tip portion of the blade 16*a* that is in contact with the intermediate transfer belt 10 receives a frictional force in the belt conveyance direction. The frictional force received by the tip of the blade 16*a* is a force in a direction in which the tip of the blade 16*a* is bent, following the intermediate transfer belt 10 moving in the belt conveyance direction. As a result, as illustrated in FIG. 2B, the contact portion of the blade 16*a* is curved due to the frictional force at the contact portion, and the blade 16*a* is caught in the intermediate transfer belt 10. A portion of the blade 16*a* that is tucked in at this time is defined as the tuck portion M, and the distance (the length) of the tuck portion M in the belt conveyance direction is defined as an "tuck amount m". Furthermore, as illustrated in FIG. 2C, let's suppose that when the blade 16*a* is brought into contact with the intermediate transfer belt 10 and is pushed by the intermediate transfer belt 10, the blade 16*a* is not deformed at all and intrudes into the facing roller 13. Then, the depth (the length) of part of the tip surface of the blade 16*a* that intrudes into the facing roller 13 measured in the tip surface direction is defined as an intrusion amount δ.

According to the present exemplary embodiment, the blade 16*a* is disposed relative to the intermediate transfer belt 10 such that a setting angle θ is 22°, the intrusion amount δ is 1.5 mm, and the contact pressure is 14 N. As used herein, the setting angle θ refers to an angle formed by the tangent line to the facing roller 13 at the intersection of the intermediate transfer belt 10 and the blade 16*a* (more specifically, the end surface of the free end) and the blade 16*a* (more specifically, one surface of the blade 16*a* that is perpendicular to the thickness direction). Furthermore, the intrusion amount δ is the length of an overlapping portion between the blade 16*a* and the facing roller 13 in the thickness direction. The contact pressure is defined by the pressing force (linear pressure in the longitudinal direction) exerted by the blade 16*a* at the blade nip portion Nb. The contact pressure is measured by using a film pressure measurement system (Trade Name: PINCH available from Nitta Corporation).

Note that the blade 16*a* blocks the toner remaining on the intermediate transfer belt 10 by applying a pressure to the intermediate transfer belt 10 by the tuck portion M of the blade 16*a* which is tucked in by the frictional force between the blade 16*a* and the intermediate transfer belt 10. Thereafter, the toner blocked by the blade 16*a* is collected into the waste toner container 16*b*. Thus, in order to ensure toner collectability, the blade 16*a* is in pressure contact with the intermediate transfer belt 10 at a predetermined pressure so as to prevent the toner from slipping through.

However, if the pressure of the blade 16*a* against the intermediate transfer belt 10 is too high, the frictional force applied to the tip of the blade 16*a* increases and, thus, the tuck amount m of the tuck portion M of the blade 16*a* increases. If the tuck amount m becomes too large, complete tuck may occur. The blade 16*a* that is in contact with the intermediate transfer belt 10 while being directed in the counter direction may be in contact with the intermediate transfer belt 10 while being directed in the belt conveyance direction (hereinafter referred to as "turn-over"). If the turn-over occurs, it becomes difficult to block the toner remaining on the intermediate transfer belt 10 by the blade 16*a*, resulting in faulty cleaning. For this reason, to ensure the collectability of the toner remaining on the intermediate transfer belt 10, it is necessary to appropriately set the tuck amount m of the blade 16*a*.

As a method for adjusting the tuck amount m of the blade 16*a*, a method is developed for adjusting the dynamic friction coefficient of the intermediate transfer belt 10 and controlling the frictional force applied to the tuck portion M of the blade 16*a*. For example, the surface of the intermediate transfer belt 10 is provided with a plurality of grooves or irregularities extending in the belt conveyance direction to reduce the contact area between the blade 16*a* and the intermediate transfer belt 10 and reduce the dynamic friction coefficient between the intermediate transfer belt 10 and the blade 16*a*. Thus, the frictional force can be reduced. In this manner, the tuck amount m of the blade 16*a* with respect to the intermediate transfer belt 10 can be controlled. Alternatively, as a unit for adjusting the tuck amount m of the blade 16*a*, a method is developed for adjusting the frictional force applied to the tuck portion M of the blade 16*a* by previously applying a lubricant, such as fluorinated graphite, to the tip of the blade 16*a*.

Intermediate Transfer Belt

Figure 3:
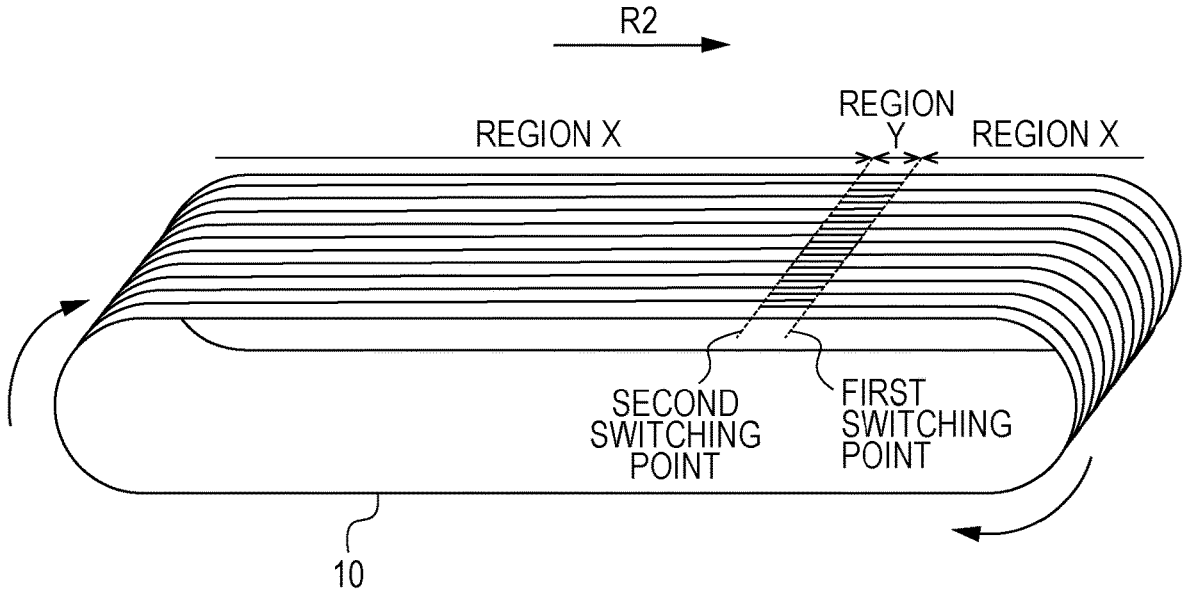
FIG. 3 is a schematic illustration of the overall configuration of an intermediate transfer belt according to the first exemplary embodiment.
Figure 4A:
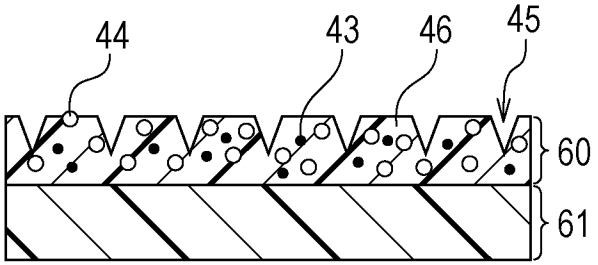
FIGS. 4A to 4D are schematic illustrations of the surface configurations of the intermediate transfer belt in a first region and a second region of the intermediate transfer belt according to the first exemplary embodiment.
Figure 4B:
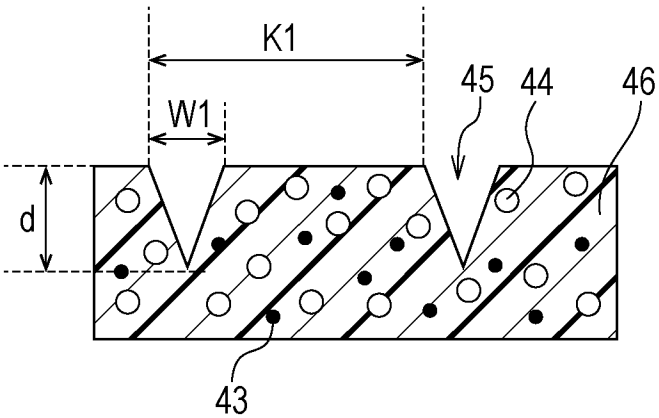
Figure 4C:
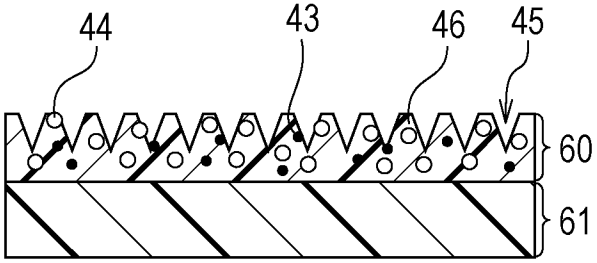
Figure 4D:
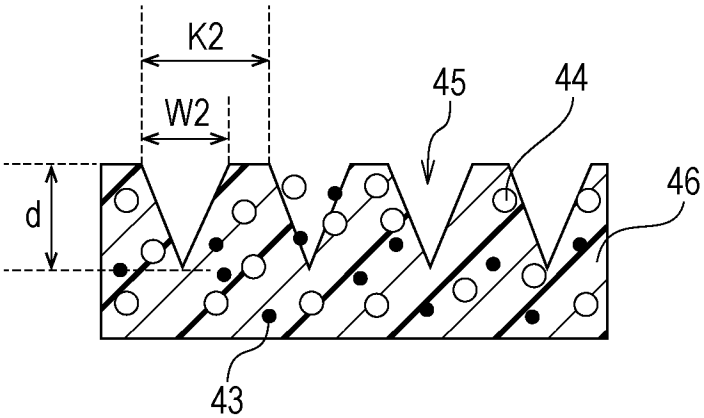

The configuration of the intermediate transfer belt 10 according to the present exemplary embodiment is described below. FIG. 3 is a schematic illustration of the overall configuration of the intermediate transfer belt 10. FIG. 4A is a schematic enlarged partial cross-sectional view of the intermediate transfer belt 10 in a region X of FIG. 3 when the intermediate transfer belt 10 is cut in a direction substantially perpendicular to the belt conveyance direction (as viewed in the belt conveyance direction). FIG. 4B is an enlarged partial cross-sectional view of FIG. 4A and illustrates a surface layer 60 of the intermediate transfer belt 10 (described below) in more detail. FIG. 4C is a schematic enlarged partial cross-sectional view of the intermediate transfer belt 10 in a region Y of FIG. 3 when the intermediate transfer belt 10 is cut in a direction substantially perpendicular to the belt conveyance direction (as viewed in the belt conveyance direction). FIG. 4D is an enlarged partial cross-sectional view of FIG. 4C and illustrates the surface layer 60 of the intermediate transfer belt 10 in more detail.

The intermediate transfer belt 10 is an endless belt member (or an endless film-like member) composed of two layers, a base layer 61 and the surface layer 60. The circumferential length of the intermediate transfer belt 10 is 700 mm, and the longitudinal width in the belt width direction is 250 mm. As used herein, the term "base layer" refers to the thickest one of the layers that constitute the intermediate transfer belt 10 with respect to the thickness direction of the intermediate transfer belt 10. According to the present exemplary embodiment, the base layer 61 is made of polyethylene naphthalate resin containing dispersed quaternary ammonium salt, which is an ionic conductive agent serving as an electrical resistance adjusting agent. The base layer 61 is 70 mm in thickness.

Note that the material of the base layer 61 is not limited to the above-described one. For example, instead of polyethylene naphthalate resin, the base layer 61 may be made of a thermoplastic resin. Examples of a thermoplastic resin include polycarbonate, polyvinylidene fluoride (PVDF), polyethylene, polypropylene, polymethylpentene-1, polystyrene, polyamide, polysulfone, polyarylate, polyethylene terephthalate, polybutylene terephthalate, polyethylene naphthalate, polyphenylene sulfide, polyethersulfone, polyethernitrile, thermoplastic polyimide, polyetheretherketone, thermotropic liquid crystal polymer, and polyamide acid. Two or more of these can be mixed and used. Moreover, as an ionic conductive agent added to the base layer 61, ionic liquid, a conductive oligomer, or a quaternary ammonium salt can be used, for example. One or more of these conductive materials may be appropriately selected and used. Alternatively, an electronic conductive material and an ion conductive material may be mixed and used.

The surface layer 60 is a layer that forms the outer circumferential surface of the intermediate transfer belt 10. The surface layer 60 according to the present embodiment is obtained by dispersing antimony-doped zinc oxide, which serves as an electrical resistance adjusting agent 43, in an acrylic resin which forms a base material 46, and polytetrafluoroethylene (PTFE) particles, which are fluorine-containing particles, are added to the acrylic resin as the solid lubricant 44. The surface layer 60 is 3 μm in thickness.

Other than an acrylic resin, an example of an organic base material 46 of the surface layer 60 is a cured resin, such as a melamine resin, a urethane resin, an alkyd resin, and a fluorine-type cured resin (fluorine-containing cured resin). Examples of an inorganic material include alkoxysilane/alkoxyzirconium-based materials and silicate-based materials. Examples of an organic/inorganic hybrid material include inorganic fine particle-dispersed organic polymer materials, inorganic fine particle-dispersed organoalkoxysilane materials, acrylic silicon materials, and organoalkoxysilane materials.

In addition, an example of the conductive agent added to the surface layer 60 is a particulate, fibrous, or flaky carbon-based conductive filler, such as carbon black, PAN-based carbon fiber, or expanded graphite pulverized product. Alternatively, for example, particulate, fibrous or flaky metallic conductive filler, such as silver, nickel, copper, zinc, aluminum, stainless steel, or iron, can be used. Still alternatively, for example, a particulate metal oxide conductive filler, such as zinc antimonate, antimony-doped tin oxide, antimony-doped zinc oxide, tin-doped indium oxide, or aluminum-doped zinc oxide, can be used.

From the viewpoint of strength, such as wear resistance or crack resistance, the surface layer 60 is preferably a resin material (a cured resin) among cured materials. Among the cured resins, an acrylic resin obtained by curing an unsaturated double bond-containing acrylic copolymer is more preferable. According to the present exemplary embodiment, the surface layer 60 of the intermediate transfer belt 10 is achieved by applying liquid containing ultraviolet curable monomer and/or oligomer component to the surface of the base layer 61 and, thereafter, emitting an energy ray, such as ultraviolet ray, to cure the liquid.

According to the present exemplary embodiment, the volume resistivity of the intermediate transfer belt 10 is $1\times10^{10}$ Ω·cm. The volume resistivity was measured with a UR probe (model MCP-HTP12) connected to Hiresta-UP (MCP-HT450) available from Mitsubishi Chemical Corporation, with an applied voltage of 100V and a measurement time of 10 seconds. The environment of a measurement chamber for measuring the volume resistivity was set to a temperature of 23° C. and a humidity of 50%, and the intermediate transfer belt 10 was placed in the environment for four hours. Thereafter, the volume resistivity of the intermediate transfer belt 10 was measured.

As illustrated in FIG. 3 and FIGS. 4A to 4D, the intermediate transfer belt 10 according to the present exemplary embodiment has a region X (a first region) and a region Y (a second region) in which the surface layer 60 is subjected to a surface processing treatment in order to prevent wear of the blade 16*a*. The surface processing is carried out on an area defined by a width greater than or equal to the width of the blade 16*a* and the entire length extending in the belt conveyance direction. In addition, as illustrated in FIG. 3, the intermediate transfer belt 10 has a first switching point at which the region X is changed to the region Y in the belt conveyance direction and a second switching point at which the region Y is changed to the region X. That is, the intermediate transfer belt 10 has the single region X that is formed continuously in the belt conveyance direction and the single region Y that is formed continuously in the belt conveyance direction. In the following description, with respect to the belt conveyance direction, the distance from the first switching position to the second switching position is defined as a distance of the region Y, and the distance from the second switching position to the first switching position is defined as a distance of the region X. According to the present exemplary embodiment, the distance of the region Y is 50 mm, and the distance of the region X is 650 mm.

According to the present exemplary embodiment, as illustrated in FIGS. 4A to 4D, a plurality of grooves (groove shapes or groove portions) 45 that extend in the belt conveyance direction are formed in the region X and the region Y so as to be arranged in the belt width direction. An interval K1 between the grooves 45 in the region X is 20 μm, and an interval K2 between the grooves 45 in the region Y is 10 μm (described in more detail below). According to the configuration, the intermediate transfer belt 10 according to the present exemplary embodiment has a dynamic friction coefficient that is smaller in the region Y than in the region X.

The configuration of the grooves 45 formed in the region X and the region Y of the intermediate transfer belt 10 is described with reference to FIGS. 4A to 4D. In the following description, the shape of the groove 45 was measured by using L-trace & NanoNavill (available from SII Nanotechnology Inc.). The measurement was carried out in the DFM mode using the high-aspect probe SI-40H as the cantilever.

As illustrated in FIGS. 4A and 4B, in the region X, a width W1 of an opening portion of the groove 45 in the belt width direction (hereinafter simply referred to as a "width W1") is 1 μm. In addition, a depth d from a surface of the surface layer 60 with no groove (the opening portion) to the bottom of the groove 45 in the thickness direction of the intermediate transfer belt 10 (hereinafter simply referred to as a "depth d") is 2 μm. The interval K1 between the grooves 45 in the belt width direction is 20 μm. Note that according to the present exemplary embodiment, the groove shapes illustrated in FIGS. 4A and 4B are formed in the region X of the intermediate transfer belt 10 by pressing a columnar die having convex portions formed at intervals of 20 μm against the surface layer 60 and rotating the die.

Subsequently, as illustrated in FIGS. 4C and 4D, in the region Y, a width W2 of the opening portion of the groove 45 in the belt width direction (hereinafter simply referred to as a "width W2") is 1 μm, as in the region X. In addition, as in the region X, a depth d from a surface of the surface layer 60 with no groove (the opening portion) to the bottom of the groove 45 in the thickness direction of the intermediate transfer belt 10 (hereinafter simply referred to as a "depth d") is 2 μm. Unlike the region X, in the region Y, an interval K2 between the grooves 45 in the belt width direction is set to 10 μm, which is smaller than the interval K1 in the region X. Note that according to the present exemplary embodiment, the groove shapes illustrated in FIGS. 4C and 4D are formed in the region Y of the intermediate transfer belt 10 by pressing a columnar die having convex portions formed at intervals of 10 μm against the surface layer 60 and rolling the die.

The width W1 and width W2 of the grooves 45 are preferably about half the average particle diameter of the toner, from a cleaning performance perspective. If the width W1 and the width W2 of the groove 45 are too large, toner particles may enter the grooves 45 and, thus, slip through the blade nip portion Nb, resulting in faulty cleaning. However, if the width W1 and the width W2 of the groove 45 are too small, the contact area between the blade 16*a* and the intermediate transfer belt 10 becomes too large, resulting in increased friction at the blade nip portion Nb and increased wear of the tip of the blade 16*a*. For this reason, according to the configuration of the present exemplary embodiment, the width W1 and the width W2 of the groove 45 are preferably set to a value greater than or equal to 0.5 μm and less than or equal to 3 μm.

According to the present exemplary embodiment, since the surface layer 60 is 3 μm in thickness, the groove 45 does not reach the base layer 61 but exists only in the surface layer 60. In addition, 650 mm of the grooves 45 are substantially continuously formed on the intermediate transfer belt 10 in the circumferential direction (the rotational direction) of the intermediate transfer belt 10.

Note that according to the present exemplary embodiment, the grooves 45 in the region X and the grooves 45 in the region Y are formed by using the columnar dice having the convex portions formed thereon at different intervals. However, the dice are not limited thereto. Even when the interval between the convex portions for the region Y is the same as that for the region X, the grooves 45 in the region Y may be formed by using a columnar die having convex portions formed obliquely with respect to the rotation direction of the cylinder and pressing the die against only the region Y and rolling the die around the entire region Y twice. That is, by pressing the columnar die for the first round in the circumferential direction of the intermediate transfer belt 10 and, thereafter, continuously pressing the columnar die against only the region Y of the intermediate transfer belt 10 for the second round, the grooves 45 are formed on the surface layer 60 having the previously formed grooves 45 in an overlapping manner. As a result, the grooves 45 can be formed in the region Y at intervals smaller than those in the region X. Thus, the intermediate transfer belt 10 having different dynamic friction coefficients for the region X and the region Y can be obtained.

Alternatively, instead of using a columnar die having obliquely formed convex portions, a columnar die having convex portions each formed in parallel to the circumferential direction may be obliquely pressed against the surface layer 60 of the intermediate transfer belt 10, and the region X and the region Y may be formed. Even in this case, by pressing the columnar die obliquely for the first round in the circumferential direction of the intermediate transfer belt 10 and, thereafter, continuously pressing the columnar die against only the region Y of the intermediate transfer belt 10 for the second round, the grooves 45 are formed on the surface layer 60 having the previously formed grooves 45 in an overlapping manner. As a result, the grooves 45 can be formed in the region Y at intervals smaller than those in the region X. Thus, the intermediate transfer belt 10 having different dynamic friction coefficients for the region X and the region Y can be obtained.

At this time, the thickness of the surface layer 60 needs to be greater than or equal to the thickness at which the groove 45 can be formed, that is, the depth d of the groove 45. If the thickness of the surface layer 60 is smaller than the depth d of the groove 45, the groove 45 reaches the base layer 61 and, thus, a substance added to the base layer 61 may be deposited on the surface of the surface layer 60. Consequently, faulty cleaning may occur. In contrast, if the thickness of the surface layer 60 is too large, the surface layer 60 made of an acrylic resin may be cracked, which causes faulty cleaning. For this reason, according to the configuration of the present exemplary embodiment, the thickness of the surface layer 60 is preferably set to a value greater than or equal to 1 μm and less than or equal to 5 μm and is more preferably set to a value greater than or equal to 1 μm and less than or equal to 3 μm in consideration of cracking in the surface layer 60 during long-term use.

As described above, according to the present exemplary embodiment, the contact area between the blade 16*a* and the intermediate transfer belt 10 is controlled by forming the grooves 45 in the region X and the region Y of the intermediate transfer belt 10 at different intervals. In this manner, the dynamic friction coefficient between the blade 16*a* and the intermediate transfer belt 10 is controlled to control the force applied to the tuck portion M of the blade 16*a*. Thus, wear of the blade 16*a* can be prevented. According to the present exemplary embodiment, the grooves 45 are formed in an area wider than the width of the blade 16*a* in the belt width direction. That is, the intermediate transfer belt 10 has a configuration in which the width of the region X and the region Y is greater than the width of the blade 16*a* in the belt width direction. In this way, wear of the blade 16*a* can be stably prevented over the entire width of the blade 16*a*.

Adjustment of Tuck Portion

As illustrated in FIG. 3, the intermediate transfer belt 10 of the present exemplary embodiment has the region X having the grooves 45 formed in the surface layer 60 at intervals of 20 μm and a region Y having the grooves 45 formed at intervals of 10 μm. Since the contact area between the blade 16*a* and the intermediate transfer belt 10 is larger in the region X than in the region Y, the frictional force between the blade 16*a* and the intermediate transfer belt 10 increases. As a result, the tuck portion M increases. In contrast, since the interval between the grooves 45 is small in the region Y, the contact area between the blade 16*a* and the intermediate transfer belt 10 decreases. In addition, the surface area of the intermediate transfer belt 10 increases. Consequently, an area in which the solid lubricant 44 is exposed increases. As a result, the dynamic friction coefficient between the blade 16*a* and the intermediate transfer belt 10 decreases in the region Y, as compared with the region X.

Table 1 presents comparison of the dynamic friction coefficients of the region X and the region Y and comparison of the magnitudes of the tuck amount m in the region X and the region Y. The dynamic friction coefficient and the tuck amount m corresponding to the region X were measured by using an intermediate transfer belt having the grooves 45 formed on the entire surface in the belt conveyance direction at intervals K1 (an intermediate transfer belt having only the region X). In addition, the dynamic friction coefficient and the tuck amount m corresponding to the region Y were measured by using an intermediate transfer belt having the grooves 45 formed on the entire surface in the belt conveyance direction at intervals K2 (an intermediate transfer belt having only the region Y).

TABLE 1

| | Region X | Region Y |
|---|---|---|
| Dynamic friction coefficient | 0.75 | 0.55 |
| Tuck amount m | 10 μm | 2 μm |

The dynamic friction coefficient was measured using a surface property tester ("HEIDON 14FW" available from Shinto Scientific Co., Ltd.). In the measurement, an urethane rubber ball indenter (with an outer diameter of ⅜ inch and a rubber hardness of 90 degrees) was used as a measurement indenter. The measurement conditions included a test load of 50 gf, a speed of 10 mm/sec, and a measurement distance of 50 mm. The values of the dynamic friction coefficient in Table 1 were obtained by dividing the average of the frictional forces (gf) measured in 1 second to 4 seconds from the start of measurement by the test load (gf).

In addition, the magnitude of the tuck amount m of the blade 16*a* was measured as follows. The blade 16*a* with a tip portion having fluorinated graphite applied thereto was installed for the intermediate transfer belt 10 first. Thereafter, the image forming apparatus was operated for 2 minutes in a non-image forming mode, and the blade 16*a* was removed from the image forming apparatus. The tip portion of the blade 16*a* was observed with a microscope. Subsequently, the width of a portion where fluorinated graphite applied to the tip portion of the blade 16*a* was peeled off by rubbing against the intermediate transfer belt 10 was measured. The obtained width represents the tuck amount m.

As can be seen from Table 1, in the region Y where the dynamic friction coefficient is smaller than in the region X, the tuck amount m is also smaller. That is, according to the intermediate transfer belt 10 having the region X with the first dynamic friction coefficient and the region Y with the second dynamic friction coefficient which is smaller than the first dynamic friction coefficient, the tuck amount m of the blade 16*a* in the blade nip portion Nb can be changed.

Figure 5A:
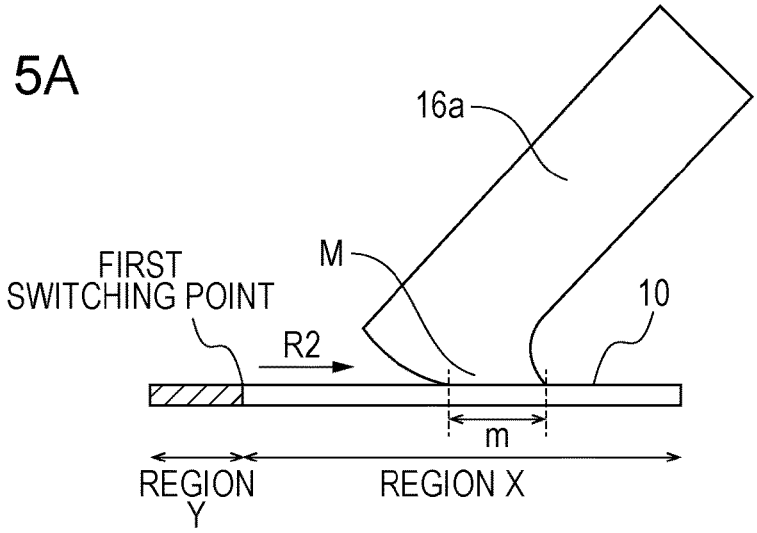
FIGS. 5A to 5C are schematic illustrations of the conditions of a tuck portion of a cleaning blade in the first region and second region of an intermediate transfer belt according to the first exemplary embodiment.
Figure 5B:
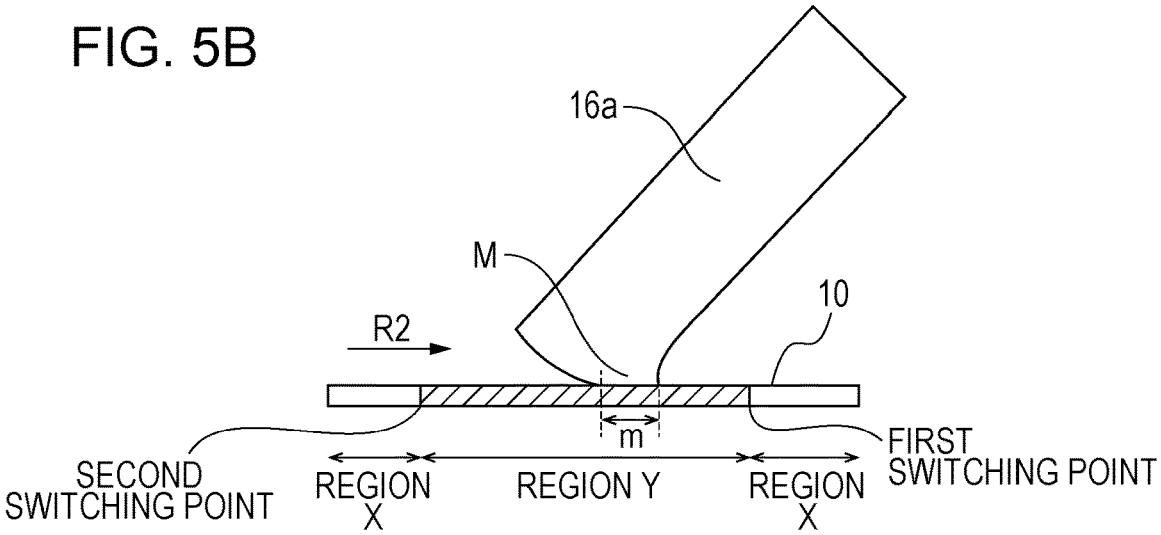
Figure 5C:
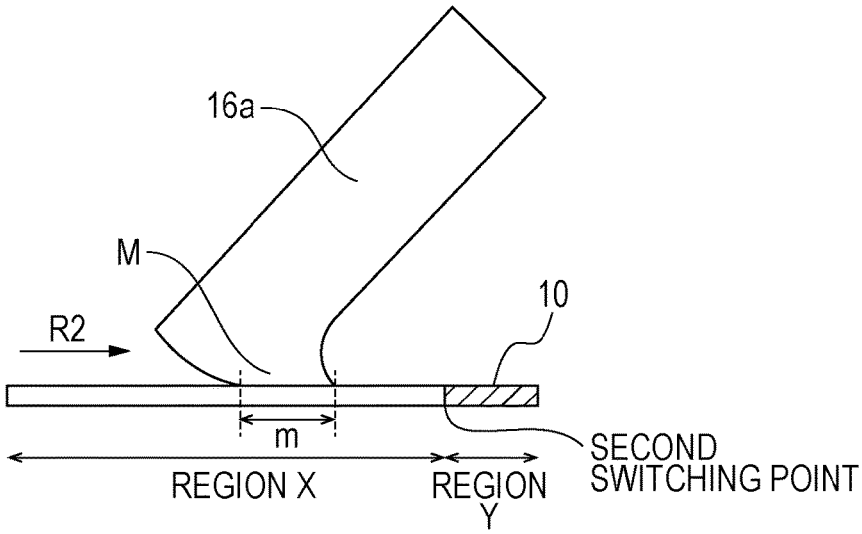

FIG. 5A is a schematic enlarged cross-sectional view of the blade 16*a* in contact with the region X in the blade nip portion Nb. FIG. 5B is a schematic enlarged cross-sectional view of the blade 16*a* in contact with the region Y after the blade 16*a* has passed the first switching position due to the movement of the intermediate transfer belt 10. FIG. 5C is a schematic enlarged cross-sectional view of the blade 16*a* in contact with the region X again after the blade 16*a* has passed the second switching position due to the movement of the intermediate transfer belt 10.

When the blade 16*a* passes through the region X, the tuck portion M of the blade 16*a* has a shape illustrated in FIG. 5A due to friction between the blade 16*a* and the region X. As illustrated in FIG. 5B, when the intermediate transfer belt 10 revolves, the blade 16*a* passes through the first switching position and is brought into contact with the region Y. As can be seen from Table 1, the dynamic friction coefficient in the region X differs from in the region Y, and the dynamic friction coefficient is reduced at the first switching position at which the region X is switched to the region Y. Then, as illustrated in FIG. 5B, the tuck portion M of the blade 16*a* is deformed, and the tuck amount m decreases. Thereafter, when the intermediate transfer belt 10 further moves and the blade 16*a* passes through the second switching position and is brought into contact with the region X again, the shape of the tuck portion M returns to it's original shape illustrated in FIG. 5A, as illustrated in FIG. 5C.

As described above, when the blade 16*a* passes through the first switching position and the second switching position, the shape of the tuck portion M of the blade 16*a* changes and, thus, the tuck amount m changes. As a result, as illustrated in FIGS. 5A to 5C, the contact condition between the blade 16*a* and the intermediate transfer belt 10 can be changed as the intermediate transfer belt 10 moves.

Figure 6A:
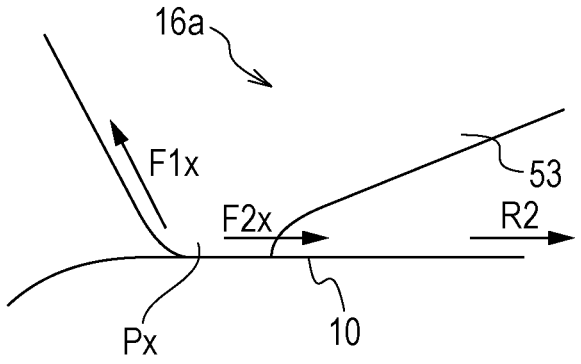
FIGS. 6A and 6B are schematic illustrations of the movement of a stress concentration portion in the tuck portion of the cleaning blade in the first region and the second region of the intermediate transfer belt according to the first exemplary embodiment.
Figure 6B:
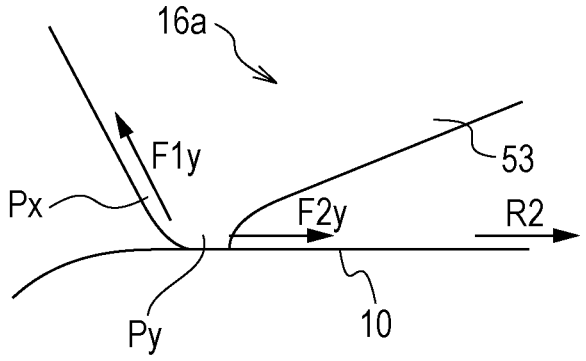

FIG. 6A is a schematic illustration of the force applied to the tuck portion M of the blade 16*a* when the blade 16*a* passes through the region X, and FIG. 6B is a schematic illustration of the force applied to the tuck portion M of the blade 16*a* when the blade 16*a* passes through the region Y. As illustrated in FIG. 6A, when the blade 16*a* passes through the region X, a restoring force F1*x* of the blade 16*a* that attempts to restore the deformation of the tuck portion M and a frictional force F2*x* caused by the revolution of the intermediate transfer belt 10 are generated in the tuck portion M. At a position at which the restoring force F1*x* crosses the frictional force F2*x*, a stress concentration portion Px at which a shearing force exerted on the tuck portion M concentrates is formed. In addition, as illustrated in FIG. 6B, when the blade 16*a* passes through the region Y, a restoring force Fly of the blade 16*a* that attempts to restore the deformation of the tuck portion M and a frictional force F2*y* caused by the revolution of the intermediate transfer belt 10 are generated in the tuck portion M. At a position at which the restoring force Fly crosses the frictional force F2*y*, a stress concentration portion Py at which a shearing force exerted on the tuck portion M concentrates is formed.

In the configuration according to the present exemplary embodiment, by using the intermediate transfer belt 10 having the region X and the region Y having a dynamic friction coefficient smaller than in the region X, the tuck amount m of the tuck portion M of the blade 16*a* can be changed. As a result, as illustrated in FIGS. 6A and 6B, in the region Y, the stress concentration portion Px of the blade 16*a* disappears, and the new stress concentration portion Py is formed. In this way, it is possible to prevent wear of the blade 16*a* in the stress concentration portion Px.

Note that according to the present exemplary embodiment, the distance of the region Y is set to be greater than the distance of the blade nip portion Nb and less than the distance of the region X in the belt conveyance direction. With respect to the belt conveyance direction, the entire area of the blade nip portion Nb is included in the region Y. In this manner, the tuck amount m of the tuck portion M of the blade 16*a* can be changed, and the stress concentration portion Px of the blade 16*a* can be made disappear. Accordingly, the distance of the region Y needs to be set greater than the distance of the blade nip portion Nb in the belt conveyance direction.

Furthermore, if the distance of the area Y is greater than the distance of the area X in the belt conveyance direction, the area of the intermediate transfer belt 10 having a low dynamic friction coefficient is larger than the area having a high dynamic friction coefficient, so that the transfer residual toner is likely to pass through the nip portion for collection. As a result, faulty cleaning may occur. Such faulty cleaning easily occurs if the intermediate transfer belt 10 has a low dynamic friction coefficient and the amount of residual toner that reaches the blade nip portion Nb varies in the width direction of the blade 16*a* perpendicular to the belt conveyance direction. More specifically, if the amount of transfer residual toner that reaches the blade nip portion Nb varies in the width direction of the blade 16*a* in accordance with the image pattern at the time of image formation, the frictional force between the intermediate transfer belt 10 and the blade 16*a* may decrease locally. In this case, there is a possibility that the stress concentration portion Py disappears because the tuck amount m in the region Y is small. Thus, the tuck portion M of the blade 16*a* may be lifted, so that the blade nip portion Nb may locally disappear. At this time, faulty cleaning caused by slipping-through of the residual transfer toner may occur at the position where the blade nip portion Nb disappears. For this reason, it is desirable that the distance of the region Y be set to be less than the distance of the region X in the belt conveyance direction.

As described above, according to the configuration of the present exemplary embodiment, the occurrence of faulty cleaning can be reduced without increasing the cost of the image forming apparatus and without reducing the throughput of the image forming apparatus.

Note that it is desirable that the width in the belt width direction of the region Y be greater than the width of the blade 16*a*. This is because if the width of the region Y is greater than the width of the blade nip portion Nb, the entire blade 16*a* can be operated to move the tuck portion M greatly when passing through the first switching position.

Furthermore, according to the configuration of the present exemplary embodiment, the interval K2 between the grooves 45 in the region Y is 10 μm. However, the interval K2 is not limited to 10 μm. If the difference in dynamic friction coefficient between the blade 16*a* and the intermediate transfer belt 10 between the region X and the region Y is too large, a change in tuck amount m of the tuck portion M when the blade 16*a* passes the first switching position and the second switching position is large. In this case, slipping-through of the residual transfer toner may easily occur during the change in the tuck amount m. For this reason, it is desirable that the difference between the dynamic friction coefficient in the region X and that in the region Y be less than or equal to 0.3.

The intervals K2 between the grooves 45 in the region Y are not necessarily equal, and it is only required that the average value in the range of 20 μm, which is the groove interval in a direction perpendicular to the extending direction of the grooves 45 in the region X, satisfy the above-described relationship regarding the difference between the dynamic friction coefficients.

Evaluation of Cleaning Performance

Subsequently, the cleaning performance of the intermediate transfer belt 10 according to the present exemplary embodiment and the cleaning performance of an intermediate transfer belt of a comparative example in the image forming apparatus 100 were evaluated. In the comparative example, an intermediate transfer belt has no groove 45, and a constant tuck amount is formed over the entire circumference of the intermediate transfer belt at all times.

To evaluate the cleaning performance, a durability test to form text images having a printing ratio of 1% for each color in a two-page intermittent mode was carried out. In the test, an image was formed once every 5,000 letter size sheets (trade name "Vitality" available from Xerox Corporation) to determine whether faulty cleaning occurred. Note that the evaluation test was performed in an environment with a temperature of 15° C. and a humidity of 10%.

To determine whether faulty cleaning occurred once every 5,000 sheets in the above-described durability test, the following technique was used. The output from the secondary transfer power source 21 was switched off (0 V) first and, thereafter, a red solid image (a solid image of 100% yellow and 100% magenta) was formed. Subsequently, the output from the secondary transfer power source 21 is set to a proper value, and five sheets of transfer medium P not having an image formed thereon were continuously fed. That is, it was determined whether faulty cleaning occurred by determining whether residual toner not transferred to the transfer medium P for the red solid image at the secondary transfer portion N2 was removed by the blade 16*a*.

If the toner for the red solid image can be completely removed from the intermediate transfer belt 10, the five sheets of transfer medium P that are continuously fed are output as substantially completely blank sheets. However, if the toner for the red solid image cannot be completely removed, the toner that has slipped through the blade 16*a* reaches the secondary transfer portion N2 again, so that the toner is transferred to the five sheets of transfer medium P that are continuously fed. Consequently, an image subjected to faulty cleaning is formed and output. The occurrence of faulty cleaning was monitored in the above-described manner once every 5,000 sheets of transfer medium P, and the evaluation was carried out for 100,000 sheets of transfer medium P in total.

As a result of evaluation of the cleaning performance, according to the configuration of the exemplary embodiment, faulty cleaning does not occur up to 100,000 sheets. In contrast, according to the configuration of the comparative example, faulty cleaning occurs after 50,000 sheets are fed.

When the tip portion of the cleaning blade used in the comparative example was observed with a microscope, the urethane rubber was worn by friction with the intermediate transfer belt 10, and the cleaning blade was worn, starting from the vicinity of the middle point of the tuck portion. This is because the dynamic friction coefficient between the intermediate transfer belt 10 and the cleaning blade is large and, thus, the cleaning blade is easily worn at the tuck portion M.

As described above, according to the configuration of the present exemplary embodiment, the intermediate transfer belt 10 is used that has the region X and the region Y having a dynamic friction coefficient lower than that of the region X. Thus, the stress concentration portion Px of the tuck portion M formed in the blade 16*a* can be periodically made disappear. As a result, it is possible to prevent the occurrence of faulty cleaning while preventing the wear of the blade 16*a* and improving the durability.

According to the present exemplary embodiment, to change the dynamic friction coefficient of the intermediate transfer belt 10, the process of forming the grooves 45 is performed on the surface layer 60 of the intermediate transfer belt 10. However, the technique is not limited thereto. As another technique, for example, the surface layer 60 of the intermediate transfer belt 10 may be polished by using a polishing member, such as a lapping film, to change the polishing strengths. Alternatively, a process for forming grooves in one of the region X and the region Y and polishing the other may be performed. Still alternatively, the region X and the region Y may be polished by using lapping films having different roughnesses. More specifically, the region X of the surface layer 60 of the intermediate transfer belt 10 may be polished with a fine lapping film (Lapika #10000 (product name) available from KOVAX Corporation), and the region Y may be polished with a rough lapping film (Lapika #2000 (product name) available from KOVAX Corporation). When the surface is polished with a rough lapping film, the surface has a roughness higher than that polished with a fine lapping film. In addition, an exposed area of the solid lubricant increases and, thus, the dynamic friction coefficient of the surface can be decreased.

According to the present exemplary embodiment, as illustrated in FIG. 3, the grooves 45 are formed in the region X and the region Y in parallel to the belt conveyance direction. However, the present invention is not limited thereto. The grooves 45 only need to extend in a direction crossing the width direction perpendicular to the movement direction of the intermediate transfer belt 10. The grooves 45 may be formed at an angle with respect to the movement direction of the intermediate transfer belt 10. However, to obtain the effect of reducing the dynamic friction coefficient between the intermediate transfer belt 10 and the blade 16*a*, an angle formed by the direction in which the groove 45 extends and the movement direction of the intermediate transfer belt 10 is preferably 45° or less and is more preferably 10° or less.

As another technique for changing the dynamic friction coefficients in the region X and the region Y, coating liquid containing lubricating particles may be sprayed over the region Y. A spray application portion has a high surface roughness and increases the exposed area of the solid lubricant. In this way, the dynamic friction coefficient may be decreased.

Second Exemplary Embodiment

According to the first exemplary embodiment, the configuration is described in which the dynamic friction coefficients in the region X and the region Y are changed by controlling the intervals K1 and K2 between the grooves 45 formed in the surface layer 60 of the intermediate transfer belt 10. In contrast, according to the second exemplary embodiment, a configuration is described in which a width W1 of a groove 45 and a width W2 of a groove 45 formed in the surface layer 60 of the intermediate transfer belt 10 are controlled before and after the first switching position and before and after the second switching position to control the dynamic friction coefficients in the region X and the region Y. Note that the configuration of the present exemplary embodiment is substantially the same as the configuration of the first exemplary embodiment except that the widths W1 and W2 of the grooves 45 are controlled. Accordingly, the same reference numerals are used in the present exemplary embodiment to describe those constituent elements that are identical to the constituent elements of the first exemplary embodiment, and description of the constituent elements are not repeated.

Figure 7A:
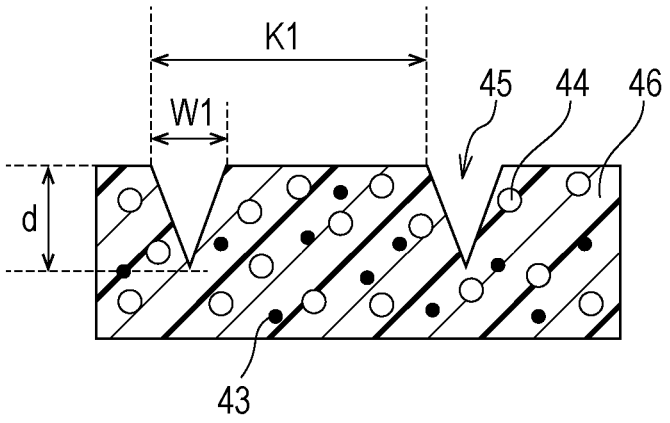
FIGS. 7A and 7B are schematic illustrations of the surface configurations in the first region and the second region of the intermediate transfer belt according to a second exemplary embodiment.
Figure 7B:
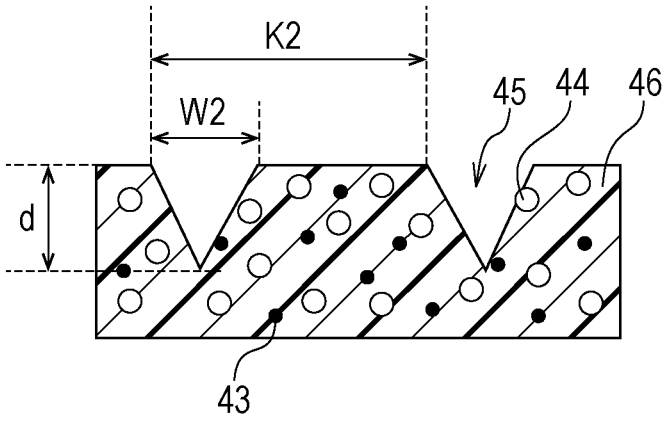

FIG. 7A is a schematic illustration of the interval K1 and the width W1 of the groove 45 in the region X according to the present exemplary embodiment, and FIG. 7B is a schematic illustration of the interval K1 and the width W1 of the groove 45 in the region Y according to the present exemplary embodiment. As illustrated in FIGS. 7A and 7B, according to the present exemplary embodiment, the interval K1 between the grooves 45 in the region X is the same as the interval K2 in the region Y, and the width W2 of the groove 45 in the region Y is changed so as to be greater than the width W1 of the groove 45 in the region X.

More specifically, according to the first exemplary embodiment, the interval K1 between the grooves 45 in the region X is set to 20 μm, and the interval K2 between the grooves 45 in the region Y is set to 10 μm. In this case, the contact area between the blade 16*a* and the intermediate transfer belt 10 is 95% in the region X and is 90% in the region Y. For this reason, according to the present exemplary embodiment, to satisfy a dynamic friction coefficient relationship the same as in the first exemplary embodiment, both the interval K1 and the interval K2 are set to 20 μm, the width W1 of the groove 45 in the region X is set to 1 μm, and the width W2 of the groove 45 in the region Y is set to 2 μm. In this manner, the effect the same as that of the first exemplary embodiment can be obtained.

Note that like the first exemplary embodiment, even in the present exemplary embodiment, the width W1 and the width W2 of the grooves 45 are preferably less than about half the average particle diameter of the toner, from a cleaning performance perspective. This is because if the width W1 and the width W2 of the grooves 45 are too large and if the toner enters the grooves 45, the toner may slip through the blade nip portion Nb, resulting in faulty cleaning. However, if the width W1 and the width W2 of the grooves 45 are too small, the contact area between the blade 16*a* and the intermediate transfer belt 10 becomes too large, resulting in increased friction at the blade nip portion Nb and increased wear of the tip portion of the blade 16*a*. For this reason, even in the configuration of the present exemplary embodiment, the width W1 and the width W2 of the grooves 45 are preferably set to a value greater than or equal to 0.5 μm and less than or equal to 3 μm. In addition, like the first exemplary embodiment, according to the present exemplary embodiment, it is desirable that the difference between the dynamic friction coefficients in the region X and the region Y be less than or equal to 0.3.

As described above, according to the configuration of the present exemplary embodiment, the same effects as those of the first exemplary embodiment can be obtained. Furthermore, the grooves 45 can be adjusted so that the change in the dynamic friction coefficient from the region X to the region Y or from the region Y to the region X is continuous. As a result, the tuck portion M can be continuously changed in the movement direction of the intermediate transfer belt 10, and slipping-through of the residual transfer toner and turn-over of the blade 16*a* can be more effectively prevented when the posture of the blade 16*a* changes.

While the present exemplary embodiment has been described with reference to the configuration in which the interval K1 between the grooves 45 in the region X is the same as the interval K2 in the region Y and, moreover, the width W2 of the groove 45 in the region Y is changed so as to be greater than the width W1 of the groove 45 in the region X, the configuration is not limited thereto. Any interval K1 between the grooves 45 in the region X and any interval K2 in the region Y that differs from the interval K1 may be set if the difference between the dynamic friction coefficients in the region X and the region Y is less than or equal to 0.3 and the width W1 and the width W2 of the grooves 45 are greater than or equal to 0.5 μm or more and less than or equal to 3.

Other Exemplary Embodiments

Another configuration of the image forming apparatus 100 according to the first exemplary embodiment is described below that further improves the durability of the blade 16*a*. The same reference numerals are used in the following description to describe those constituent elements that are identical to the constituent elements of the first exemplary embodiment, and description of the constituent elements are not repeated.

More specifically, according to the present exemplary embodiment, if image formation is not performed for a long period of time, the movement of the intermediate transfer belt 10 is stopped with the blade 16*a* in contact with the region Y of the intermediate transfer belt 10. In this manner, the operation performed by the image forming apparatus 100 is stopped. In this case, the tuck amount m is small as compared with the case where the operation of the image forming apparatus 100 is stopped with the blade 16*a* in contact with the region X of the intermediate transfer belt 10. Thus, a force exerted on the stress concentration portion Py of the blade 16*a* can be reduced. As a result, deformation of the edge portion of the blade 16*a* can be prevented more, and the durability of the blade 16*a* can be improved more.

It can be determined which one of the region X and the region Y of the intermediate transfer belt 10 the blade 16*a* is in contact with by, for example, providing a detection unit that detects the position of the intermediate transfer belt 10. Alternatively, the positions of the region X and the region Y may be detected by detecting the position of the intermediate transfer belt 10 with a detection unit, such as a sensor, that detects a detection toner image to be transferred from the photoconductive drum 1 to the intermediate transfer belt 10 in order to set the image formation conditions.

Third Exemplary Embodiment

A third exemplary embodiment is described below with reference to FIGS. 8 to 10. An image forming apparatus 100 according to the present exemplary embodiment does not include a contact member that is in contact with the photoconductive drums 1*a* to 1*d*, each serving as an image bearing member, and that collects toner remaining on the photoconductive drums 1*a* to 1*d* (transfer residual toner. That is, the image forming apparatus 100 has a configuration known as a cleaner-less configuration. In such a cleaner-less configuration, if an adhering substance, such as transfer residual toner, on the photoconductive drums 1*a* to 1*d* cannot be sufficiently removed from the surfaces of the photoconductive drums 1*a* to 1*d*, image defect caused by the adhering substance may occur. According to the present exemplary embodiment, a cleaner-less configuration of an image forming apparatus capable of preventing the occurrence of image defect caused by an adhering substance on the photoconductive drums 1*a* to 1*d* is described.

Configuration of Image Forming Apparatus

Figure 8:
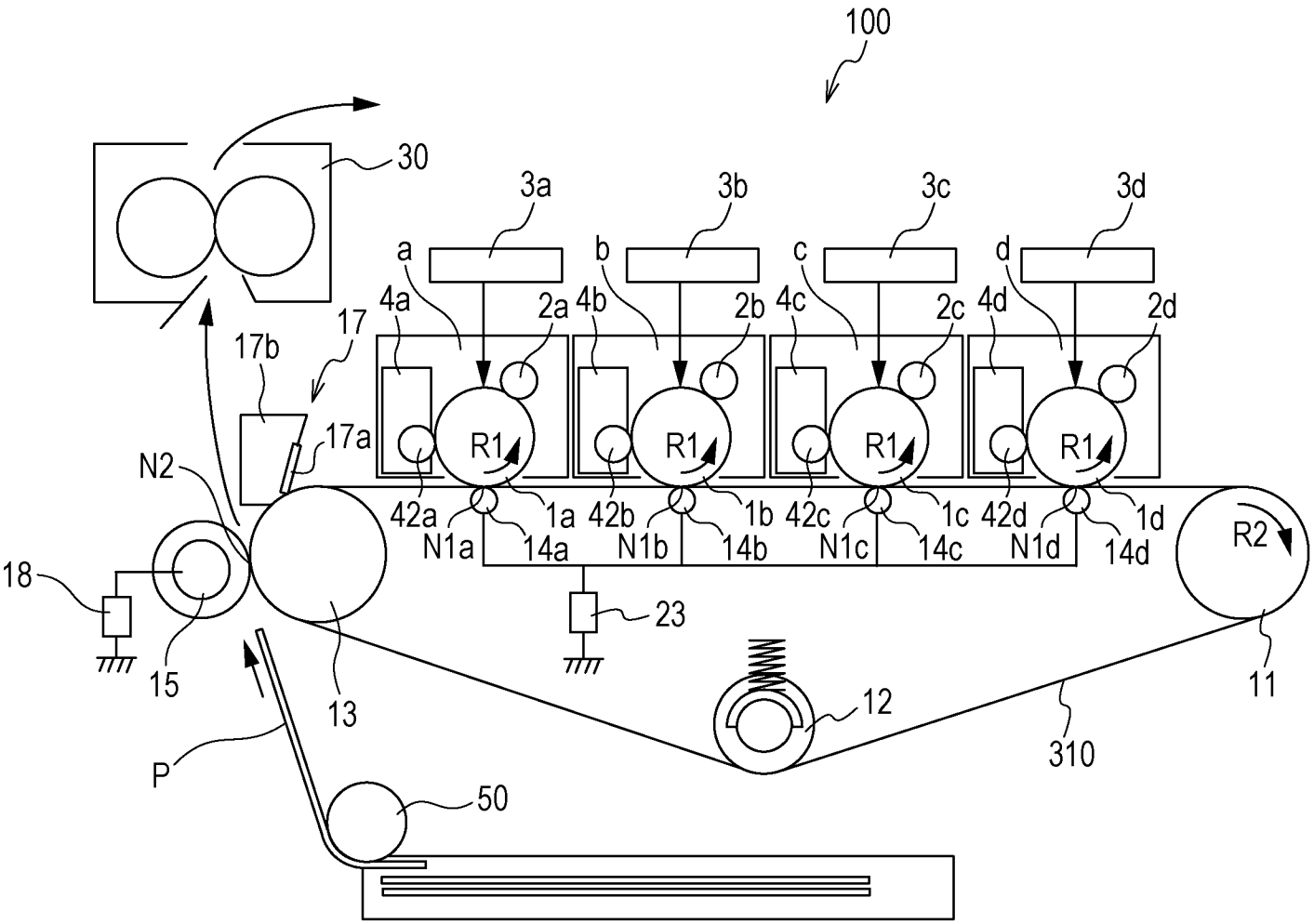
FIG. 8 is a schematic cross-sectional view illustrating the configuration of an image forming apparatus according to a third exemplary embodiment.

FIG. 8 is a schematic cross-sectional view of the configuration of the image forming apparatus 100 according to the present exemplary embodiment. As illustrated in FIG. 8, the image forming apparatus 100 according to the present exemplary embodiment is what is called a tandem type image forming apparatus provided with a plurality of image forming units a to d. The first image forming unit a forms an image by using yellow (Y) toner, the second image forming unit b forms an image by using magenta (M) toner, the third image forming unit c forms an image by using cyan (C) toner, and the fourth image forming unit d forms an image by using black (Bk) toner. These four image forming units are arranged in a line at regular intervals, and the four image forming units have substantially the same configuration except for the color of the toner to be stored. So, the image forming apparatus according to the present exemplary embodiment is described below with reference to the first image forming unit a.

The first image forming unit a includes a photoconductive drum 1*a* which is a drum-shaped photoconductive member, a charging roller 2*a* which is a charging member, an exposure unit 3*a*, and a developing unit 4*a*. The photoconductive drum 1*a* is an image bearing member that bears a toner image and is driven to rotate in a direction indicated by an arrow R1 in FIG. 8 (a counterclockwise direction) at a predetermined peripheral speed (process speed) in response to a driving force received from a driving source (not illustrated). Note that the image forming units a to d according to the present exemplary embodiment have a configuration known as a cleaner-less configuration in which cleaning members in contact with the photoconductive drums 1*a* to 1*d* are not provided.

When a control unit (not illustrated) receives an image signal, an image forming operation is started, and the photoconductive drum 1*a* is driven to rotate. During rotation, the photoconductive drum 1*a* is uniformly charged to a predetermined potential with a predetermined polarity (a negative polarity according to the present exemplary embodiment) by the charging roller 2*a* and is exposed to light in accordance with the image signal by the exposure unit 3*a*. In this way, an electrostatic latent image corresponding to the yellow component image of a target color image is formed. Subsequently, the electrostatic latent image is developed by the developing unit 4*a* at a development position and is visualized on the photoconductive drum 1*a* as a yellow toner image. According to the present exemplary embodiment, the normal charging polarity of the toner stored in the developing unit 4*a* is a negative polarity. An electrostatic latent image is developed using discharged area development, with the toner charged to the same polarity as the charging polarity of the photoconductive drum 1*a* by the charging roller 2*a*. However, the present invention is applicable to an image forming apparatus that develops an electrostatic latent image by using charged area development, with toner charged to a positive polarity which is opposite to the charging polarity of the photoconductive drum 1*a*.

The charging roller 2*a* serving as a charging member is in contact with a surface of the photoconductive drum 1*a* and is driven to rotate by the rotation of the photoconductive drum 1*a* due to friction with the surface of the photoconductive drum 1*a*. In addition, the charging roller 2*a* is a roller member in which a core metal having a diameter of 5.5 mm is provided with an elastic layer made from a conductive elastic body having a thickness of 1.5 mm and a volume resistivity of about $1\times10^6$ Ω·cm. The charging roller 2*a* receives a predetermined voltage from a charging power source (not illustrated) in accordance with an image forming operation. Note that when a voltage of −1100 (V) is applied to the charging roller 2*a* from the charging power source (not illustrated), the surface potential of the photoconductive drum 1*a* is about −500 (V) (measured using Model 344 Electrostatic Voltmeter available from TREK, INC.).

The exposure unit 3*a* includes a laser driver, a laser diode, a polygon mirror, an optical system lens, and the like. The exposure unit 3*a* emits a laser beam in accordance with image information input from a host computer (not illustrated) and forms an electrostatic latent image on the surface of the photoconductive drum 1*a*. According to the present exemplary embodiment, the amount of light is controlled such that when the photoconductive drum 1*a* is exposed to the maximum amount of light emitted from the exposure unit 3*a*, a surface potential V1 of the photoconductive drum 1*a* is −100 (V).

The developing unit 4*a* includes a development roller 42*a* serving as a developing member and yellow toner. The developing unit 4*a* supplies the toner to the photoconductive drum 1*a* and develops an electrostatic latent image formed on the photoconductive drum 1*a* into a toner image. The development roller 42*a* can be brought into contact with the photoconductive drum 1*a* and can be separated from the photoconductive drum 1*a*. The development roller 42*a* is brought into contact with the photoconductive drum 1*a* (the contact width is predetermined) and supplies the toner. The development roller 42*a* rotates in a direction opposite to an arrow R1 illustrated in FIG. 8 (a clockwise direction) at a peripheral speed higher than the peripheral speed of the photoconductive drum 1*a*. A developing power source (not illustrated) is connected to the development roller 42*a*, and a predetermined voltage (−300 (V) according to the present exemplary embodiment) is applied to the development roller 42*a* in accordance with an image forming operation.

According to the present exemplary embodiment, the toner is non-magnetic one-component toner produced by a suspension polymerization process. The toner has a negative normal charging polarity. The volume average particle diameter of the toner measured with the laser diffraction particle size distribution analyzer LS-230 available from Beckman Coulter, Inc. is 6.0 μm. Furthermore, to modify the surface property, silicon oxide particles, with a weight of about 1.5% of the toner, are made to adhere to the surfaces of the toner particles as an external additive. The volume average particle diameter of the silicon oxide particle is about 20 nm. According to the present exemplary embodiment, toner produced by a suspension polymerization process is employed. However, the toner is not limited thereto. For example, the toner produced by using another polymerization process, such as a pulverization process or an emulsion polymerization process, may be employed.

The intermediate transfer belt 310 serving as an intermediate transfer member is a movable endless belt having conductivity produced by adding a conductive agent to a resin material. The intermediate transfer belt 310 is stretched around three axes of stretching rollers 11, 12, and 13. The photoconductive drums 1*a* to 1*d* are driven to rotate at substantially the same peripheral speed. The intermediate transfer belt 310 is in contact with the photoconductive drum 1*a* to form a primary transfer portion N1*a*, and the yellow toner image formed on the photoconductive drum 1*a* is primarily transferred from the photoconductive drum 1*a* in the process of passing through the primary transfer portion N1*a*.

A primary transfer roller 14*a* serving as a transfer member is provided adjacent to the inner peripheral surface of the intermediate transfer belt 310 so as to face the photoconductive drum 1*a* with the intermediate transfer belt 310 therebetween. A primary transfer power source 23 serving as a potential forming unit is connected to the primary transfer roller 14*a*. The primary transfer roller 14*a* is formed as a straight nickel-plated SUS round bar having an outer diameter of 6 mm. The primary transfer roller 14*a* is in contact with the intermediate transfer belt 310 over a predetermined region of the intermediate transfer belt 310 in the longitudinal direction crossing the movement direction of the intermediate transfer belt 310. The intermediate transfer belt 310 is driven to rotate by the revolution of the intermediate transfer belt 310.

In accordance with the image forming operation, the primary transfer power source 23 applies a voltage of 500 (V) to the primary transfer roller 14*a*. As a result, a potential is formed on the conductive intermediate transfer belt 310, and the yellow toner image is primarily transferred from the photoconductive drum 1*a* to the intermediate transfer belt 310. Note that according to the present exemplary embodiment, a configuration in which a voltage is applied from the primary transfer power source 23 common to the primary transfer rollers 14*a* to 14*d* is employed. However, the present invention is not limited thereto, and transfer power sources for applying voltages to the primary transfer rollers 14*a* to 14*d* may be provided individually. Alternatively, only some of the primary transfer rollers 14*a* to 14*d* may use a common transfer power source.

Similarly, the second, third, and fourth image forming units b, c, and d form a second color magenta toner image, a third color cyan toner image, and a fourth color black toner image, respectively. The toner images are sequentially primarily transferred to the intermediate transfer belt 310 on top of another. As a result, four color toner images corresponding to the target color image are formed on the intermediate transfer belt 310. Subsequently, when the four color toner images born by the intermediate transfer belt 310 pass through a secondary transfer portion N2 formed by contact of a secondary transfer roller 15 with the intermediate transfer belt 310, the four color toner images are secondarily transferred onto a surface of a transfer medium P, such as a paper sheet or an OHP sheet, fed by a sheet feeding unit 50 in one go.

A secondary transfer roller 15 serving as a secondary transfer member has an outer diameter of 18 mm. The secondary transfer roller 15 is formed by covering a nickel-plated steel rod having an outer diameter of 6 mm with a foamed sponge body mainly composed of NBR and epichlorohydrin rubber and having an adjusted volume resistivity of $10^8$ Ω·cm and an adjusted thickness of 6 mm. Note that the rubber hardness of the foamed sponge body was measured by using Asker hardness meter type C, and the hardness was 30°. The secondary transfer roller 15 is in contact with the outer circumferential surface of the intermediate transfer belt 310. The secondary transfer roller 15 applies a pressure of about 50 N to the facing roller 13 serving as a facing member via the intermediate transfer belt 310 and forms a secondary transfer portion N2. A secondary transfer power source 18 is connected to the secondary transfer roller 15. When the secondary transfer power source 18 applies a voltage to the secondary transfer roller 15, the toner image is secondarily transferred from the intermediate transfer belt 310 to a transfer medium P in the secondary transfer portion N2. Note that the secondary transfer power source 18 can output a voltage in the range of 100 to 4000 (V). According to the present exemplary embodiment, the secondary transfer power source 18 applies a voltage of 2500 (V). Thus, the toner image is secondarily transferred from the intermediate transfer belt 310 to the transfer medium P in the secondary transfer portion N2.

Subsequently, the four color toner images born by the intermediate transfer belt 310 are transferred onto the transfer medium P in the secondary transfer portion N2. Thereafter, the transfer medium P is led to a fixing unit 30, where the transfer medium P is heated and pressurized. Thus, the four color toner particles are melted and mixed and are fixed to the transfer medium P. The toner remaining on the intermediate transfer belt 310 after the secondary transfer is cleaned or removed by a cleaning unit 17. The cleaning unit 17 is provided so as to face the facing roller 13 via the intermediate transfer belt 310 and serves as a collection unit that collects toner remaining on the intermediate transfer belt 310. The cleaning unit 17 includes a cleaning blade 17*a* that is in contact with the outer circumferential surface of the intermediate transfer belt 310 and a waste toner container 17*b* that stores toner removed from the intermediate transfer belt 310 by the cleaning blade 17*a* and the like.

According to the present exemplary embodiment, the image forming apparatus 100 does not include a contact member that is in contact with the photoconductive drum 1*a* and collects the residual transfer toner before the toner that has passed through the primary transfer portion N1*a* and remains on the photoconductive drum 1*a* reaches a charging unit in which the charging roller 2*a* is in contact with the photoconductive drum 1*a*. More specifically, the image forming apparatus 100 has what is called cleaner-less configuration that does not include a collection member, such as a cleaning blade, that is in contact with the photoconductive drum 1*a* between the primary transfer portion N1*a* and the charging unit in the rotational direction of the photoconductive drum 1*a*. Accordingly, the transfer residual toner that remains on the photoconductive drum 1*a* after the primary transfer of the toner image from the photoconductive drum 1*a* to the intermediate transfer belt 310 is collected by the developing unit 4*a* after passing through the charging unit.

According to the image forming apparatus of the present exemplary embodiment, a full-color print image is formed through the above-described operation.

Intermediate Transfer Belt

The intermediate transfer belt 310 that is a feature of the present exemplary embodiment is described below. The intermediate transfer belt 310 is a cylindrical endless belt. The intermediate transfer belt 310 has a circumference of 700 mm. The intermediate transfer belt 310 has two layers, a base layer and a surface layer. The material of the base layer is polyimide resin, and the material of the surface layer is acrylic resin. The base layer is 70 μm in thickness, and the surface layer is 3 μm in thickness. As used herein, the term "surface layer of the intermediate transfer belt 310" refers to a layer that forms the outer circumferential surface of the intermediate transfer belt 310, that is, a layer in contact with the cleaning blade 17*a* and the photoconductive drums 1*a* to 1*d*. In contrast, the term "base layer of the intermediate transfer belt 310" refers to the thickest one of a plurality of layers that constitute the intermediate transfer belt 310 with respect to the thickness direction of the intermediate transfer belt 310.

Figure 9:
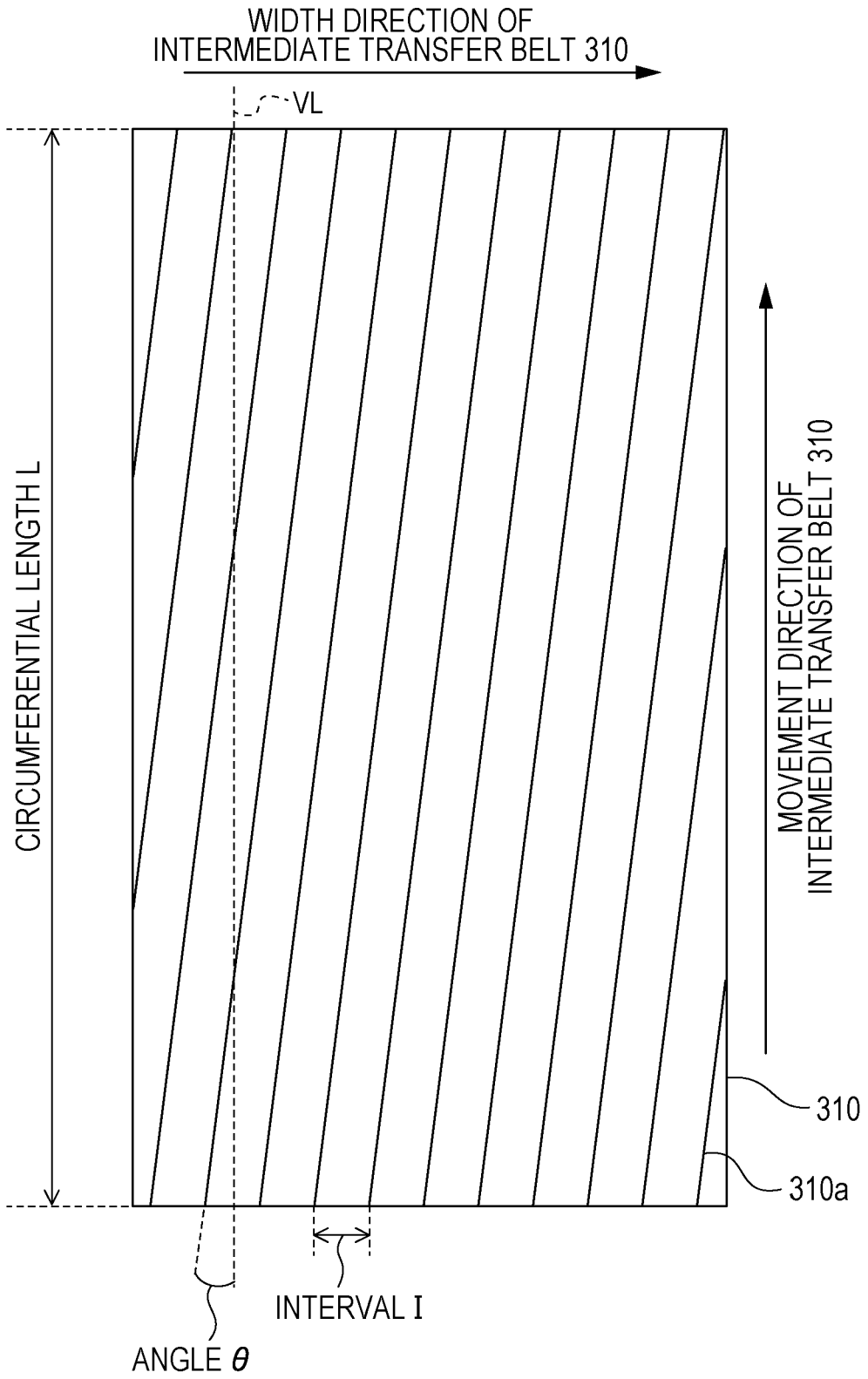
FIG. 9 is a schematic illustration of the configuration of an intermediate transfer member according to the third exemplary embodiment.

FIG. 9 is a schematic illustration of a groove 310*a* formed on the surface layer of the intermediate transfer belt 310 according to the present exemplary embodiment and is a schematic developed illustration of the endless intermediate transfer belt 310. As illustrated in FIG. 9, a surface (the surface layer) of the intermediate transfer belt 310 according to the present exemplary embodiment has a plurality of grooves 310*a* each formed at an angle of θ to an imaginary line VL extending in the movement direction of the intermediate transfer belt 310. According to the present exemplary embodiment, θ=1.5°, and the grooves 310*a* are formed at intervals of I(I=18 mm) in the width direction crossing the movement direction of the intermediate transfer belt 310. Note that according to the present exemplary embodiment, the interval I between adjacent grooves is set to satisfy the following expression (1) using the circumferential length L of the intermediate transfer belt 310 and the angle θ:

$$I \leq L \times \tan\theta \quad (1).$$

Figure 10:
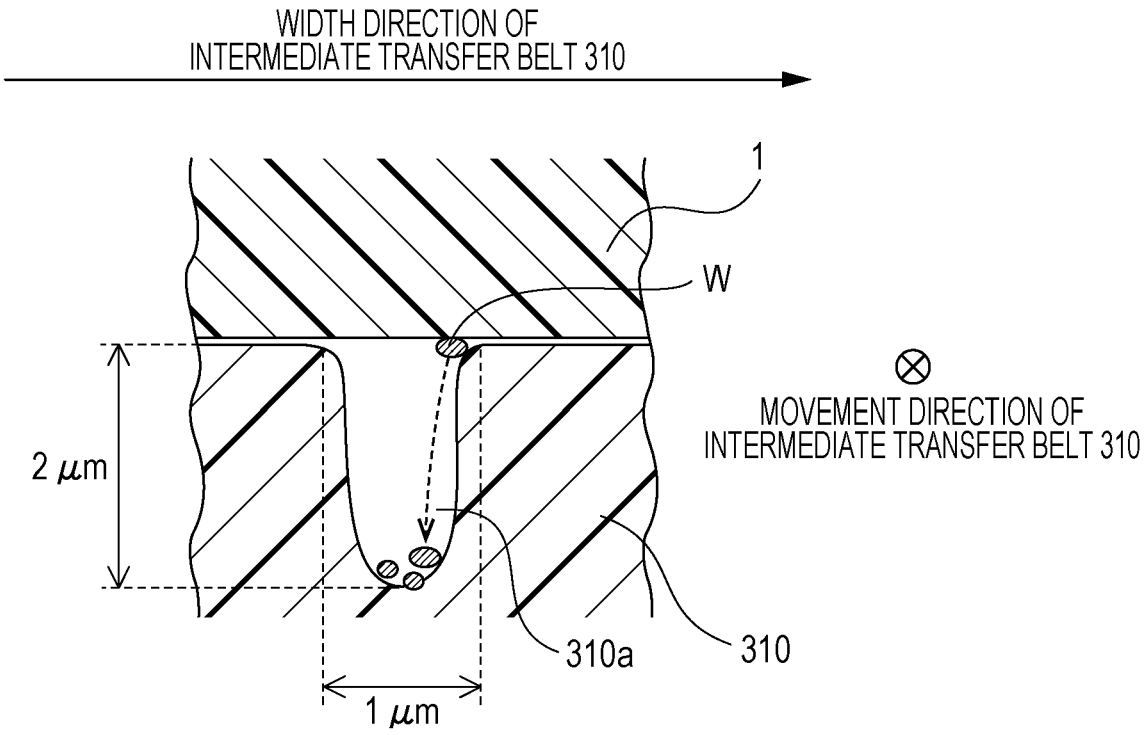
FIG. 10 is a schematic enlarged cross-sectional view of a point at which the intermediate transfer member and a photoconductive member are in contact with each other according to the third exemplary embodiment.

FIG. 10 is a schematic enlarged cross-sectional view of a contact portion between the photoconductive drum 1*a* and the intermediate transfer belt 310 in the primary transfer portion N1*a*, as viewed in the movement direction of the intermediate transfer belt 310. As illustrated in FIG. 10, according to the present exemplary embodiment, the grooves 310*a* each having a width of 1 μm and a depth of 2 μm are formed on the surface of the intermediate transfer belt 310. Note that the width and depth of the groove 310*a* are not limited to the values described above to obtain the effects of the present exemplary embodiment. However, it is more desirable that the values be less than or equal to the average particle diameter of the toner in consideration of the primary transferability of the toner.

Removal of Adhering Substance on Photoconductive Drum

The image forming apparatus 100 according to the present exemplary embodiment has a cleaner-less configuration that does not include cleaning units each in contact with the photoconductive drums 1*a* to 1*d* and collect residual transfer toner. For this reason, if residual transfer toner is not sufficiently collected by the developing units 4*a* to 4*d*, that is, if some of the residual transfer toner particles, external additives, and the like adhere to the surfaces of the photoconductive drums 1*a* to 1*d* as an adhering substance, the adhering substance may appear on the transfer medium P as an image defect. In the following description, when the same control and operation are performed for each of the member of the image forming units a to d, the suffixes "a" to "b" each attached to a reference number and indicating which one of the image forming units includes the member are removed.

FIG. 10 is a schematic enlarged cross-sectional view of the point at which the intermediate transfer belt 310 and the photoconductive drum 1 are in contact with each other according to the present exemplary embodiment. As illustrated in FIG. 10, according to the present exemplary embodiment, the grooves 310*a* are formed on the surface of the intermediate transfer belt 310 so that a adhering substance W on the photoconductive drum 1 is easily scraped off from the photoconductive drum 1. More specifically, as the intermediate transfer belt 310 moves, an edge portion of the groove 310*a* moves while being in contact with the surface of the photoconductive drum 1. In this way, the adhering substance W can be scraped off from the photoconductive drum 1.

Furthermore, as illustrated in FIG. 9, according to the present exemplary embodiment, an angle θ is formed between the groove 310*a* and the movement direction of the intermediate transfer belt 310, and the interval I between the adjacent grooves 310*a* in the width direction of the intermediate transfer belt 310 is set to be less than or equal to the circumferential length L of the intermediate transfer belt 310×tan θ. Thus, while the intermediate transfer belt 310 and the photoconductive drum 1 are rotating, the grooves 310*a* pass through all the points of the photoconductive drum 1 in the width direction of the intermediate transfer belt 310, that is, in the longitudinal direction of the photoconductive drum 1. As a result, according to the configuration of the present exemplary embodiment, the adhering substance W on the surface of the photoconductive drum 1 can be scraped off by the grooves 310*a*.

The effect of the present exemplary embodiment is described in detail below with reference to Comparative Example 1. In Comparative Example 1, an intermediate transfer belt having no groove-like concave portions was used. Comparative Example 1 is substantially the same as the present exemplary embodiment except that no groove is formed on the surface of the intermediate transfer belt. For this reason, the same reference numerals are used in Comparative example 1 to describe those constituent elements that are identical to the constituent elements of the present exemplary embodiment, and description of the constituent elements are not repeated.

Image Evaluation

To evaluate whether image defect occurred, an image having a printing ratio of 5% was continuously printed on 1000 transfer media P (A4 size paper sheets with a basis weight of 80 g/m2, Red Label available from Oce). Thereafter, to determine whether image defect occurred, a test images was formed. The test image was a toner image having a printing ratio of 100% (a solid black image) formed in an area of the transfer medium P defined by the range of 5 mm to 55 mm from the leading edge of the transfer medium P in the conveyance direction and the entire image forming area in the width direction. Such a test image was formed on the transfer medium P. Thereafter, image evaluation was carried out by determining whether the image defect occurred in an area having no toner image (a solid white portion) upstream of the area having the solid black image formed therein (a solid black portion) in the conveyance direction of the transfer medium P.

As a result of the above-described image evaluation, no image defect is observed for the configuration according to the present exemplary embodiment. In contrast, according to the configuration of Comparative Example 1, image defect occurs in which the toner for the solid black portion adheres to the solid white portion (hereinafter, the image defect is referred to as "transfer residual ghost"). More specifically, the transfer residual ghost is an image defect that occurs when the photoconductive drum 1 makes one rotation with the residual transfer toner thereon and, thereafter, the transfer residual toner is transferred to the intermediate transfer belt 310 in the next primary transfer process.

According to the configuration of the present exemplary embodiment, the grooves 310*a* are provided in the intermediate transfer belt 310. Thus, it is possible to scrape off toner or external additives attached to the photoconductive drum 1 by the intermediate transfer belt 310 that is moving. As a result, it is possible to prevent toner, external additives, and the like from adhering to the photoconductive drum 1 as the adhering substance W and to prevent the occurrence of an image defect, such as a transfer residual ghost.

In contrast, according to the configuration of Comparative Example 1, since no groove is formed in the intermediate transfer belt, an adhering substance W, such as some of the transfer residual toner and external additives, adhere to the surface of the photoconductive drum 1. As a result, a transfer residual ghost is generated due to an increase in transfer residual toner. This is because when the adhering substance W, such as transfer residual toner and external additives, adheres to the photoconductive drum 1, the releasability of the toner from the photoconductive drum 1 is reduced, so that the amount of the residual transfer toner that remains on the photoconductive drum 1 after the primary transfer process increases. For this reason, a transfer residual ghost easily occurs.

As described above, according to the configuration of the present exemplary embodiment, the grooves 310*a* that are at an angle θ to the movement direction of the intermediate transfer belt 310 are formed on the surface of the intermediate transfer belt 310. In addition, the interval I between the grooves 310*a* is set to be less than or equal to the circumferential length L of the intermediate transfer belt 310×tan θ. In this way, the adhering substance W on the photoconductive drum 1 can be removed from the surface of the photoconductive drum 1, and the occurrence of image defects due to the adhering substance W can be reduced.

According to the present exemplary embodiment, the intermediate transfer belt 310 composed of two layers, the base layer and the surface layer, has been described. However, the layer structure of the intermediate transfer belt 310 is not limited thereto if the grooves 310*a* are formed on the surface in contact with the photoconductive drum 1. For example, the intermediate transfer belt 310 may be a single layer belt having only a base layer or a multilayer belt composed of three or more layers.

Fourth Exemplary Embodiment

According to the third exemplary embodiment, the configuration has been described in which the grooves 310*a* that are at an angle θ to the movement direction of the intermediate transfer belt 310 are formed on the surface of the intermediate transfer belt 310. In contrast, according to the fourth exemplary embodiment, a description is given of a configuration in which streaky convex portions 110*b* that are an angle θ to the movement direction of the intermediate transfer belt 110 (intermediate transfer member) are formed on the surface of the intermediate transfer belt 110. Note that the configuration of the fourth exemplary embodiment is substantially the same as that of the third exemplary embodiment except that the intermediate transfer belt 110 provided with the streaky convex portions 110*b* is employed. Accordingly, in the following description, the same reference numerals are used for the configurations and control processes that are the same as those illustrated in the third exemplary embodiment, and descriptions of the configurations and control processes are not repeated.

Intermediate Transfer Belt

Figure 11:
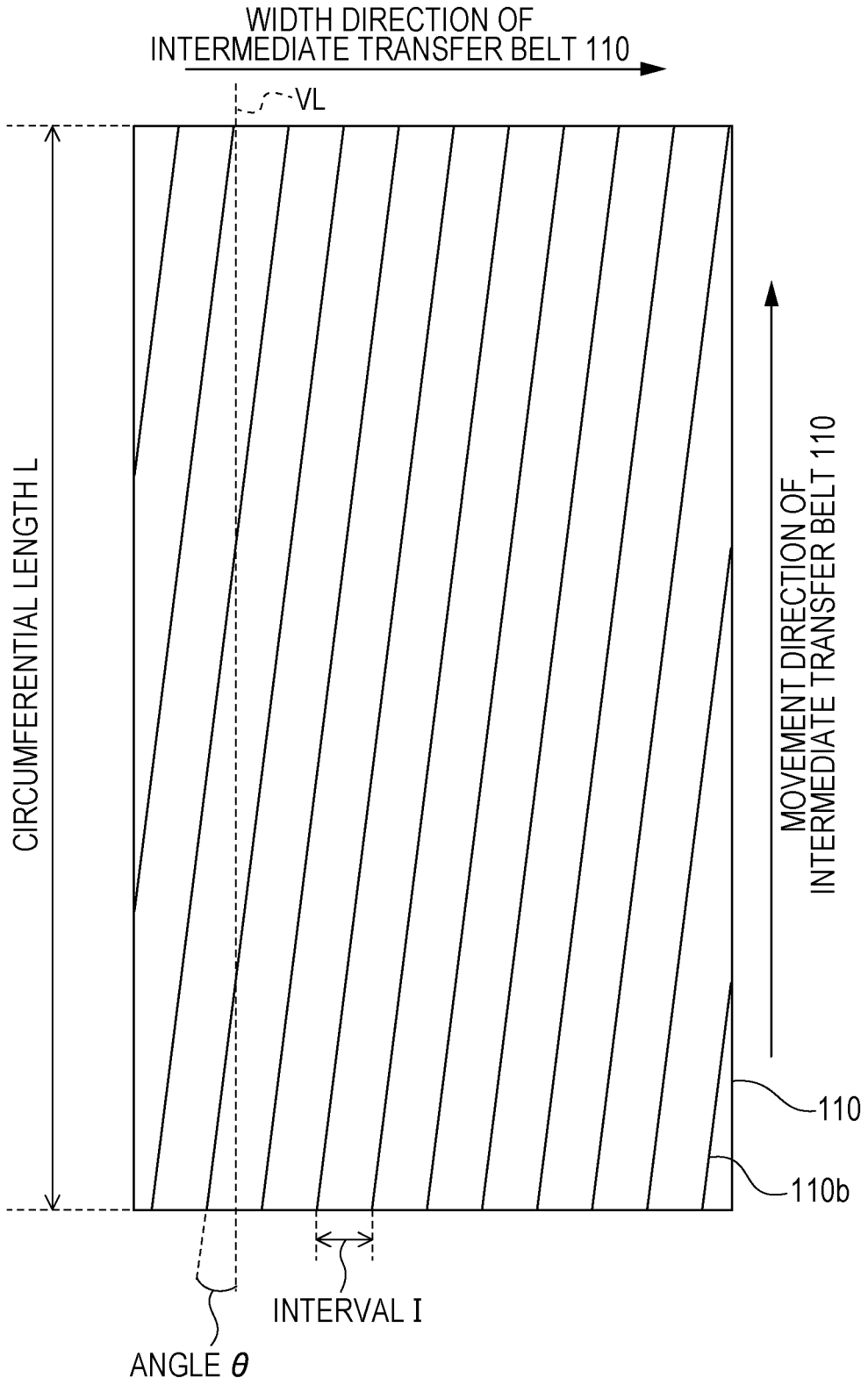
FIG. 11 is a schematic illustration of the configuration of an intermediate transfer member according to a fourth exemplary embodiment.

FIG. 11 is a schematic illustration of the convex portions 110*b* formed on the surface layer of the intermediate transfer belt 110 according to the present exemplary embodiment and is a schematic developed illustration of the endless intermediate transfer belt 110. As illustrated in FIG. 11, a surface of the intermediate transfer belt 110 according to the present exemplary embodiment has a plurality of convex portions 110*b* formed thereon. The convex portions 110*b* are at an angle θ to an imaginary line VL extending in the movement direction of the intermediate transfer belt 110. According to the present exemplary embodiment, θ=1.5°, and the convex portions 110*b* are formed at intervals I of 18 mm in the width direction crossing the movement direction of the intermediate transfer belt 110. Note that according to the present exemplary embodiment, the interval I between the adjacent convex portions is set so as to satisfy Expression (1) of the third exemplary embodiment.

Figure 12:
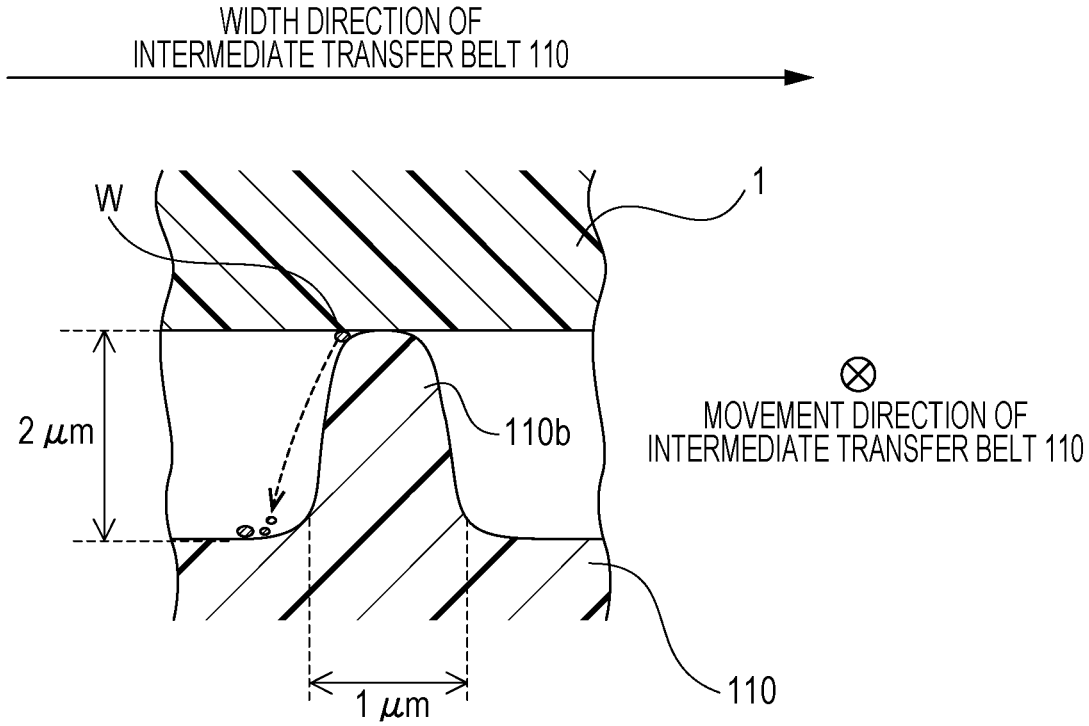
FIG. 12 is a schematic enlarged cross-sectional view of a point at which an intermediate transfer member and a photoconductive member are in contact with each other according to the fourth exemplary embodiment.

FIG. 12 is a schematic enlarged cross-sectional view of a contact portion between the photoconductive drum 1*a* and the intermediate transfer belt 110 in the primary transfer portion N1*a*, as viewed in the movement direction of the intermediate transfer belt 110. As illustrated in FIG. 12, according to the present exemplary embodiment, the convex portions 110*b* each having a width of 1 μm and a height of 2 μm are formed on the surface of the intermediate transfer belt 110. Note that the width and height of the convex portion 110*b* are not limited to the values described above to obtain the effects of the present exemplary embodiment. However, it is desirable that the width and height of the convex portion 110*b* be set to be less than or equal to the average particle diameter of the toner in consideration of the primary transferability of the toner.

Removal of Adhering Substance on Photoconductive Drum n addition to the transfer residual toner and the external additives described in the third exemplary embodiment, a corona product, such as nitride oxide, may adhere to the surface of the photoconductive drum 1. Such a corona product is generated by discharge generated in the vicinity of the charging unit where the charging roller 2*a* and the photoconductive drum 1*a* are in contact with each other. The corona product gradually accumulates on the photoconductive drum 1 as the image forming operation is repeated. If the amount of the corona product accumulated on the photoconductive drum 1 increases, the corona product absorbs moisture in a high-humidity environment, which reduces the resistance thereof and disturbs the charge in the latent image formed on the photoconductive drum 1. As a result, an image defect that reduces the density of an image may occur.

To solve such a problem, as illustrated in FIG. 12, the present exemplary embodiment employs a configuration capable of easily scraping off the adhering substance W, such as a corona product, on the photoconductive drum 1 by forming the convex portions 110*b* on the surface of the intermediate transfer belt 110. More specifically, as the intermediate transfer belt 110 moves, the convex portions 110*b* move while being in contact with the surface of the photoconductive drum 1. In this manner, the adhering substance W can be scraped off from the photoconductive drum 1.

Furthermore, as illustrated in FIG. 11, according to the present exemplary embodiment, an angle θ is formed by each of the convex portions 110*b* and the movement direction of the intermediate transfer belt 110. In addition, the interval I between the convex portions 110*b* in the width direction of the intermediate transfer belt 110 is set to be less than or equal to the circumferential length L of the intermediate transfer belt 110×tan θ. In this way, after many revolutions of the intermediate transfer belt 110 and the photoconductive drum 1, the convex portion 110*b* passes through all points of the photoconductive drum 1 in the width direction of the intermediate transfer belt 110, that is, all points of the photoconductive drum 1 in the longitudinal direction of the photoconductive drum 1. As a result, according to the configuration of the present exemplary embodiment, the adhering substance W on the surface of the photoconductive drum 1 can be scraped off by the convex portions 110*b*.

The effect of the present exemplary embodiment is described in detail below by comparing the effect with the effect of Comparative Example 2. In Comparative Example 2, an intermediate transfer belt having no convex portion formed thereon was used. Note that the other configurations of Comparative Example 2 are substantially the same as those of the present exemplary embodiment except that no convex portion is formed on the surface of the intermediate transfer belt. Accordingly, in the following description, the same reference numerals are used for the constituent elements that are the same as those in Comparative Example 2, and descriptions of the constituent elements are not repeated.

Image Evaluation

To determine whether image defect occurred, two types of test images were formed by using transfer media P (A4 size paper sheets with a basis weight of 80 g/m2, Red Label available from Oce). Thereafter, the occurrence of the image defect was examined for the two types of test images. In first image evaluation, like the image evaluation carried out in the third exemplary embodiment, an image having a printing ratio of 5% was continuously printed on 1000 transfer media P. Subsequently, to determine whether a transfer residual ghost occurred, the test images were formed. As described above, the test image was a toner image having a printing ratio of 100% (a solid black image) formed in an area of the transfer medium P defined by the range of 5 mm to 55 mm from the leading edge of the transfer medium P in the conveyance direction and the entire image forming area in the width direction.

In second image evaluation, the image forming apparatus 100 were placed in a high-temperature and high-humidity environment (a temperature of 30° C. and a humidity of 90%) for three days. Thereafter, images having a printing ratio of 5% were continuously printed on 1000 transfer media P. Subsequently, test images were formed to determine whether an image defect occurred. Note that the test image is a halftone image formed in the entire image forming area of the transfer medium P and having a printing ratio of 20%. Such test images were formed on the transfer media P, and it was determined whether an image defect that reduced the density of an image due to the corona product occurred.

As a result of the above-described image evaluation, according to the configuration of the present exemplary embodiment, neither a transfer residual ghost nor an image defect that reduces the density of an image occurs. In contrast, according to the configuration of Comparative Example 2, both a transfer residual ghost and an image defect that reduces the density of a halftone image having a printing ratio of 20% are found out.

As described above, according to the configuration of the present exemplary embodiment, the convex portions 110*b* are provided on the intermediate transfer belt 110, so that the toner and external additives adhering to the photoconductive drum 1 in accordance with the movement of the intermediate transfer belt 110 and a corona product can be scraped off. In this manner, it is possible to prevent accumulation of toner, external additives, corona products, and the like as adhering substances W on the photoconductive drum 1. Thus, the occurrence of a residual transfer ghost and an image defect that reduces the density of an image can be reduced.

In contrast, according to the configuration of Comparative Example 2, since the convex portions are not formed on the intermediate transfer belt, the adhering substance W, such as some of the transfer residual toner, external additives, or corona products, are easily accumulated on the surface of the photoconductive drum 1. As a result, a transfer residual ghost or an image defect that reduces the density of an image occurs. If the adhering substance W, such as the residual transfer toner and the external additives, is accumulated on the photoconductive drum 1, the releasability of the toner on the photoconductive drum 1 is reduced, so that the amount of transfer residual toner remaining on the photoconductive drum 1 after the primary transfer increases. For this reason, a transfer residual ghost easily occurs. Furthermore, if an adhering substance W, such as a corona product, accumulates on the photoconductive drum 1, the corona product adsorbs moisture, reduces the resistance, and disrupts the electric charge of a latent image formed on the photoconductive drum 1. As a result, an image defect that reduces the density of a halftone image easily occurs.

As described above, according to the configuration of the present exemplary embodiment, the convex portions 110*b* that are at an angle θ to the movement direction of the intermediate transfer belt 110 are formed on the surface of the intermediate transfer belt 110. In addition, the interval I between the convex portions 110*b* is set to be less than or equal to the circumferential length L of the intermediate transfer belt 110×tan θ. In this way, the adhering substance W on the photoconductive drum 1 can be removed from the surface of the photoconductive drum 1 and, thus, the occurrence of image defects caused by the adhering substance W can be reduced.

Fifth Exemplary Embodiment

The third exemplary embodiment has been described with reference to the configuration having the grooves 310*a* formed on the surface of the intermediate transfer belt 310 at an angle θ to the movement direction of the intermediate transfer belt 10. In contrast, the fifth exemplary embodiment is described below with reference to a configuration having grooves 210*a* formed on the surface of the intermediate transfer belt 210 at an angle θ to the movement direction of the intermediate transfer belt 210 (intermediate transfer member) and streaky convex portions 210*b* formed on either side of each of the grooves 210*a*. Note that the configuration according to the fifth exemplary embodiment is substantially the same as that of the third exemplary embodiment except that an intermediate transfer belt 210 having the streaky convex portions 210*b* formed on either side of each of the grooves 210*a* is used. Accordingly, in the following description, the same reference numerals are used for the constituent elements that are the same as those of the third exemplary embodiment, and descriptions of the constituent elements are not repeated.

Intermediate Transfer Belt

Like the intermediate transfer belt 10 described in the third exemplary embodiment with reference to FIG. 9, according to the present exemplary embodiment, a surface of the intermediate transfer belt 210 has the plurality of grooves 210*a* formed thereon at an angle θ to an imaginary line VL extending in the movement direction of the intermediate transfer belt 210. According to the present exemplary embodiment, θ=1.5°. In addition, the grooves 210*a* are formed at intervals I of 18 mm in the width direction crossing the movement direction of the intermediate transfer belt 210. Note that according to the present exemplary embodiment, the interval I between adjacent grooves is set so as to satisfy Expression (1) of the third exemplary embodiment.

Figure 13:
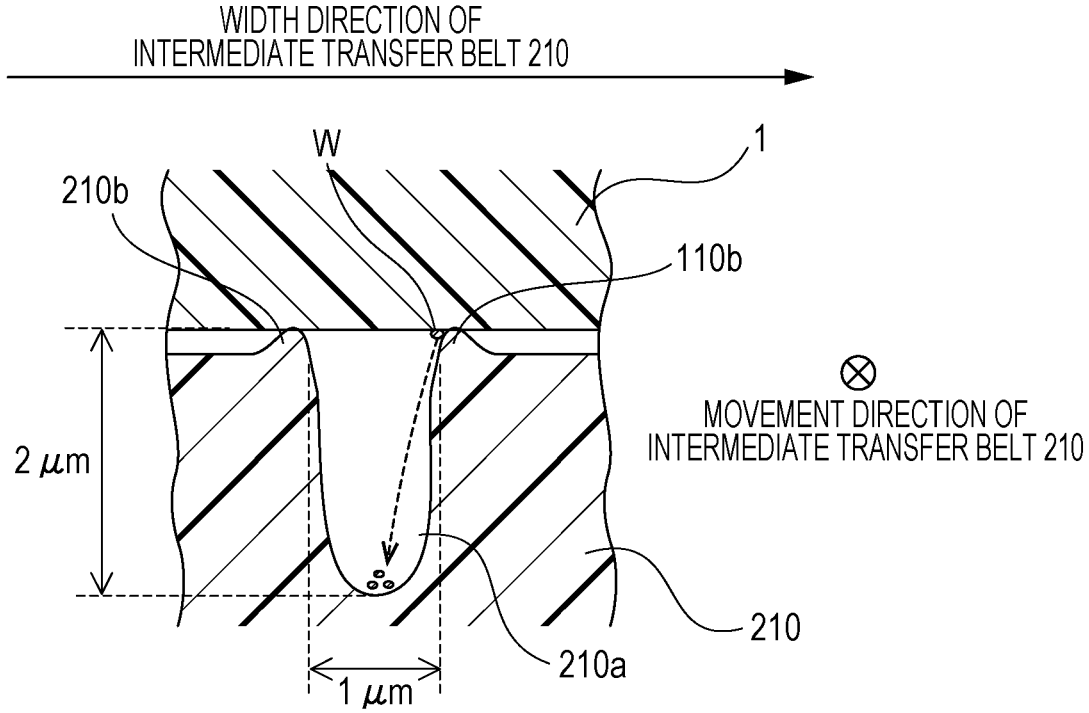
FIG. 13 is a schematic enlarged cross-sectional view of a point at which an intermediate transfer member and a photoconductive member are in contact with each other according to a fifth exemplary embodiment.

FIG. 13 is a schematic enlarged cross-sectional view of a contact portion between the photoconductive drum 1*a* and the intermediate transfer belt 210 in the primary transfer portion N1*a*, as viewed in the movement direction of the intermediate transfer belt 210. As illustrated in FIG. 13, according to the present exemplary embodiment, the grooves 210*a* each having a width of 1 μm and a depth of 2 μm are formed on the surface of the intermediate transfer belt 210. Furthermore, according to the present exemplary embodiment, the convex portions 210*b* are formed on either side of each of the groove 210*a* in the width direction of the intermediate transfer belt 210. According to the present exemplary embodiment, the width and depth of the groove 210*a* are not limited to the values described above to obtain the effects of the present exemplary embodiment. However, it is desirable that each of the values be set to be less than or equal to the average particle diameter of the toner, in consideration of the primary transferability of the toner. More specifically, it is desirable that the sum of the depth of the groove 210*a* and the height of the convex portion 210*b* formed on both sides of the groove 210*a* be set to be less than or equal to the average particle diameter of the toner. Similarly, it is desirable that the sum of the width of the groove 210*a* and the width of the convex portion 210*b* formed on both sides of the groove 210*a* be set to be less than or equal to the average particle diameter of the toner.

Image Evaluation

To determine whether image defect occurred, two types of test images were formed by using transfer media P (A4 size paper sheet with a basis weight of 80 g/m2, Red Label available from Oce). Thereafter, it was determined whether an image defect occurred for the two types of test images. In first image evaluation, like the image evaluation carried out in the third exemplary embodiment, an image having a printing ratio of 5% was continuously printed on 1000 transfer media P. Subsequently, to determine whether a transfer residual ghost occurred, a test image was formed. As described above, the test image was a toner image having a printing ratio of 100% (a solid black image) formed in an area of the transfer medium P defined by the range of 5 mm to 55 mm from the leading edge of the transfer medium P in the conveyance direction and the entire image forming area in the width direction.

In a second image evaluation, the image forming apparatus 100 were placed in a high-temperature and high-humidity environment (a temperature of 30° C. and a humidity of 90%) for three days. Thereafter, an image having a printing ratio of 5% was continuously printed on 1000 transfer media P. Subsequently, a test image was formed to determine whether an image defect occurred. Note that the test image was a halftone image formed in the entire image forming area of the transfer medium P and having a printing ratio of 20%. Such a test image was formed on the transfer media P, and it was determined whether an image defect that reduced the density of an image due to the corona product occurred.

Furthermore, according to the present exemplary embodiment, the dynamic friction coefficient of the surface of the intermediate transfer belt 210 was measured before and after the second image evaluation, and a change in the dynamic friction coefficient of the intermediate transfer belt 210 before and after the image evaluation was checked. In the measurement, the dynamic friction coefficient was measured using a surface property tester ("HEIDON 14FW" available from Shinto Scientific Co., Ltd.). At this time, an urethane rubber ball indenter (with an outer diameter of ⅜ inch and a rubber hardness of 90 degrees) was used as a measurement indenter. The measurement conditions included a test load of 50 gf, a speed of 10 mm/sec, and a measurement distance of 50 mm. The values of the dynamic friction coefficient were obtained by dividing the average of the frictional forces (gf) measured in 1 second to 4 seconds from the start of measurement by the test load (gf).

As a result of the above-described image evaluation, like the third and fourth exemplary embodiments, in even the configuration according to the present exemplary embodiment, neither a transfer residual ghost nor an image defect that reduces the density of an image occurs. As described above, according to the configuration of the present exemplary embodiment, the convex portions 210*b* are provided on the intermediate transfer belt 210. Consequently, toner, external additives, and a corona product adhering to the photoconductive drum 1 can be scraped off by the intermediate transfer belt 210 that is moving. As a result, it is possible to prevent accumulation of toner, external additives, corona products, and the like as adhering substances W on the photoconductive drum 1. Thus, the occurrence of a residual transfer ghost and an image defect that reduces the density of an image can be reduced.

In addition, according to the configuration of the present exemplary embodiment, the dynamic friction coefficient of the intermediate transfer belt 210 before the second image evaluation is 0.42, and the dynamic friction coefficient of the intermediate transfer belt 210 after the second image evaluation is 0.45. That is, the dynamic friction coefficient is almost unchanged. This is because the groove 210*a* is formed in the vicinity of the convex portion 210*b* of the intermediate transfer belt 210 and, therefore, the adhering substance W, such as a corona product, scraped off from the photoconductive drum 1 by the intermediate transfer belt 210 is collected into the groove 210*a*. That is, the reason why a change in the dynamic friction coefficient is small is that a corona product and other adhering substance W scraped off from the photoconductive drum 1 are difficult to adhere to the surface of the intermediate transfer belt 210.

If the friction coefficient of the intermediate transfer belt 210 changes greatly, contact between the cleaning blade 17*a* that collects toner remaining on the intermediate transfer belt 210 and the intermediate transfer belt 210 may become unstable. In this case, faulty cleaning may occur, or noise may be generated due to vibration of the cleaning blade 17*a*. For this reason, if as in the present exemplary embodiment, the dynamic friction coefficient of the intermediate transfer belt 210 is small, stable cleaning performance that lasts for a long time can be easily achieved.

In the third to fifth exemplary embodiments described above, the cleaner-less configurations of the image forming apparatus have been described that solve the problem of the occurrence of an image defect caused by an adhering substance on the photoconductive drums 1*a* to 1*d*. To solve the problems presented in the third to fifth exemplary embodiments, the intermediate transfer belt 10 does not necessarily have to have the region X and the region Y having different dynamic friction coefficients described in the first and second exemplary embodiments. However, it will be obvious that the configuration of the intermediate transfer belt having the region X and the region Y having different dynamic friction coefficients described in the first and second exemplary embodiments can be applied to the configuration of the intermediate transfer belts described in the third to fifth exemplary embodiments. According to the configuration of the image forming apparatus obtained in this way, the wear of the cleaning blade serving as a contact member can be reduced and, thus, the durability of the cleaning blade can be improved. At the same time, the occurrence of faulty cleaning can be prevented. Furthermore, an image defect caused by an adhering substance on the photoconductive drum can be reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An endless intermediate transfer member, that is movable in a movement direction when used in an image forming apparatus, for transferring a toner image from an image bearing member, comprising:

a first region which is formed on a surface of the intermediate transfer member in the movement direction; and a second region, which is different from the first region and which is formed on a surface of the intermediate transfer member in the movement direction, wherein the first region has a plurality of grooves, which are arranged in a width direction perpendicular to the movement direction and extended in the movement direction, wherein the second region has a dynamic friction coefficient, which is less than that of the first region, in the movement direction, and wherein a length of the second region in the movement direction is less than that of the first region in the movement direction.

2. The intermediate transfer member according to claim 1, further comprising a first switching position at which the first region is switched to the second region and a second switching position at which the second region is switched to the first region with respect to the movement direction.

3. The intermediate transfer member according to claim 2, wherein in the movement direction, a distance from the first switching position to the second switching position is a distance of the second region, and a distance from the second switching position to the first switching position is a distance of the first region.

4. The intermediate transfer member according to claim 1, wherein the second region has a plurality of grooves, which are formed on a surface of the intermediate transfer member and extended in the movement direction, and the grooves being arranged in the width direction.

5. The intermediate transfer member according to claim 4, wherein an interval between the grooves in the second region is smaller than that in the first region, in the width direction.

6. The intermediate transfer member according to claim 4, wherein a width of the groove in the second region is greater than that in the first region, in the width direction.

7. The intermediate transfer member according to claim 1, wherein a difference of a value of the dynamic friction coefficient, between the second region and the first region is less than or equal to 0.3.

8. The intermediate transfer member according to claim 1, wherein a value of surface roughness in the second region is greater than that in the first region.

9. The intermediate transfer member according to claim 1, wherein among layers that constitute the intermediate transfer member in a thickness direction of the intermediate transfer member, the intermediate transfer member includes a base layer and a surface layer formed on a surface of the base layer, the base layer having the largest thickness and having an ion conductive agent added thereto, and wherein the first region and the second region are regions formed on the surface layer.

10. The intermediate transfer member according to claim 9, wherein a thickness of the surface layer is set to be less than or equal to 3 μm.

11. The intermediate transfer member according to claim 9, wherein the surface layer is made of acrylic copolymer.

12. The intermediate transfer member according to claim 9, wherein the surface layer has fluorine-containing particles added thereto.

13. The image forming apparatus according to claim 1, further comprising a contact member, wherein the first region at least includes an area in which a contact portion to be contacted with the contact member is formed in the width direction, and the second region at least includes an area in which the contact portion is formed in the width direction.

14. The image forming apparatus according to claim 13, wherein the length of the second region is greater than that of the contact portion, in the movement direction.

* * * * *